US010062538B2

(12) United States Patent
Aditya et al.

(10) Patent No.: US 10,062,538 B2
(45) Date of Patent: Aug. 28, 2018

(54) ELECTRON DEVICE AND METHOD FOR MANUFACTURING AN ELECTRON DEVICE

(71) Applicant: Nanyang Technological University, Singapore (SG)

(72) Inventors: Sheel Aditya, Singapore (SG); Zhao Chen, Singapore (SG)

(73) Assignee: Nanyang Technological University, Singapore (SG)

( * ) Notice: Subject to any disclaimer, the term of this patent is extended or adjusted under 35 U.S.C. 154(b) by 230 days.

(21) Appl. No.: 14/876,191

(22) Filed: Oct. 6, 2015

(65) Prior Publication Data

US 2016/0099127 A1 Apr. 7, 2016

(30) Foreign Application Priority Data

Oct. 7, 2014 (SG) ..... 10201406372Q

(51) Int. Cl.
*H01J 25/34* (2006.01)
*H01J 23/26* (2006.01)
*H01J 23/28* (2006.01)

(52) U.S. Cl.
CPC ..... *H01J 25/34* (2013.01); *H01J 23/26* (2013.01); *H01J 23/28* (2013.01)

(58) Field of Classification Search
CPC ..... H01J 25/34; H01J 23/26; H01J 23/28
USPC ..... 331/82
See application file for complete search history.

(56) References Cited

U.S. PATENT DOCUMENTS 4,785,261 A * 11/1988 Bacon ..... H01J 25/42 315/3.6
4,847,565 A * 7/1989 Hasegawa ..... H01L 45/02 257/E45.006
5,038,076 A 8/1991 Smith et al.

FOREIGN PATENT DOCUMENTS

SG 170554 A1 2/2012

OTHER PUBLICATIONS

A. Dallos, et al., *Simulation of Rod Charging in TWT Helix Structures*, in International Technical Digest on Electron Devices Meeting, (1989) 199-202.
Christie, V. L. et al., *Improved Equivalent Circuit Model of Practical Coupled-Cavity Slow-Wave Structures for TWTs*, Microwave and Optical Technology Letters, vol. 35, No. 4 (Nov. 2002) 322-326.
Chua, C. et al., *Effective Dielectric Constant Method for a Planar Helix With Straight-Edge Connections*, IEEE Electron Device Letters, vol. 30, No. 11, (Nov. 2009) 1215-1217.
(Continued)

*Primary Examiner* — Joseph Chang
(74) *Attorney, Agent, or Firm* — Alston & Bird LLP

(57) ABSTRACT

According to embodiments of the present invention, an electron device is provided. The electron device includes a support substrate, a conductive planar slow-wave structure on the support substrate, the conductive planar slow-wave structure being adapted to receive an electromagnetic wave signal for interaction with an electron beam, and a dielectric layer arrangement in between the conductive planar slow-wave structure and the support substrate, the dielectric layer arrangement being arranged on the support substrate at only one or more support substrate portions overlapping with the conductive planar slow-wave structure. According to further embodiments of the present invention, a method for manufacturing an electron device is also provided.

20 Claims, 15 Drawing Sheets

(56) References Cited

OTHER PUBLICATIONS

Chua, C. et al., *Microfabricated planar helical slow-wave structures based on straight-edge connections for THz vacuum electron devices*, Terahertz Science and Technology, vol. 4, No. 12 (Dec. 2011) 208-229.

Chua, C. et al., *Microfabrication and Characterization of W-Band Planar Helix Slow-Wave Structure with Straight-Edge Connections*, IEEE Transactions on Electron Devices, vol. 58, No. 11, (Nov. 2011) 4098-4105.

Freund, H.P. et al., *Theory of helix traveling wave tubes with dielectric and vane loading*, Physcis of Plasmas, vol. 3, No. 8 (Aug. 1996) 3145-3161.

Kory, C. et al., *Interaction simulations of two 650 GHz BWOs using MAFIA*, in IVEC (2008) 390-391.

Kory, C. L., *Three-Dimensional Simulation of Helix Traveling-Wave Tube Cold-Test Characteristics Using MAFIA*, IEEE Trans. Electron Devices, vol. 43, No. 8 (1996) 1317-1319.

Kory, C.L. et al., *Novel High-Gain, Improved-Bandwidth, Finned-Ladder V-Band Traveling-Wave Tube Slow-Wave Circuit Design*, IEEE Transactions on Electron Devices, vol. 42, No. 9, (Sep. 1995) 1686-1692.

Leou, K.C. et al., *Dielectric-Loaded Wideband Gyro-TWT*, IEEE Transactions on Plasma Science, vol. 20, No. 3 (Jun. 1992) 188-196.

Sengele, S. et al., *Microfabrication and Characterization of a Selectively Metallized W-Band Meander-Line TWT Circuit*, IEEE Transactions on Electron Devices, vol. 56, No. 5, (May 2009) 730-737.

Shen, F. et al., *Symmetric Double V-Shaped Microstrip Meander-Line Slow-Wave Structure for W-Band Traveling-Wave Tube*, IEEE Transactions on Electron Devices, vol. 59, No. 5, (May 2012) 1551-1557.

*Simulation of 650 GHz Backward Wave Oscillators*, Retrieved from the Internet: <URL: https://www.cst.com/Applications/Article?id=429> (2015) 4 pages.

Singh, G., *Analytical Study of the Interaction Structure of Vane-Loaded Gyro-Traveling Wave Tube Amplifier*, Progress in Electromagn. Research B, vol. 4 (2008) , 41-66.

Zhao, C. et al., *A Microfabricated Planar Helix Slow-Wave Structure to Avoid Dielectric Charging in TWTs*, IEEE Transactions on Electron Devices, vol. 62, No. 4 (Apr. 2015) 1342-1348.

Zhao, C. et al., *Symmetric Planar Helix Slow-Wave Structure with Straight-Edge Connections for Application in TWTs*, in IVEC (2014), 291-293.

* cited by examiner

ELECTRON DEVICE AND METHOD FOR MANUFACTURING AN ELECTRON DEVICE

CROSS-REFERENCE TO RELATED APPLICATION

This application claims the benefit of priority of Singapore patent application No. 10201406372Q, filed 7 Oct. 2014, the content of it being hereby incorporated by reference in its entirety for all purposes.

TECHNICAL FIELD

Various embodiments relate to an electron device and a method for manufacturing an electron device.

BACKGROUND

High power microwave sources, for example, microwave and millimeter wave high power electronic devices are important in the modern society. These sources/devices have wide applications in, for example, civilian infrastructure and consumer markets (e.g., broadcast media transmission, satellite communication, civilian radar, etc.), military (e.g., electronic countermeasures, high-power weapons, etc.), scientific applications (e.g., plasma heating, particle accelerators, etc.) and industrial applications (e.g., testing and instrumentation, materials processing, etc.).

Vacuum electron devices (VEDs) typically stand out from the solid state devices at high power and high frequencies as VEDs generally exhibit more reliable performance, higher efficiency, and lower cost and weight per watt. Despite the inroads made by solid-state devices, the current business of VEDs is estimated at about 1 billion USD. Among the different types of VEDs, travelling-wave tubes (TWTs) are noteworthy due to their large bandwidth and linearity. Communications satellites, airborne radar systems and unmanned aerial vehicles (UAVs) commonly use travelling-wave tube amplifiers (TWTAs). TWTs have a majority share of 65% in the VED business and it has been projected that such majority share may be maintained in the coming years.

A travelling wave tube (TWT) is one of the most widely used high power microwave devices. The TWT has the largest bandwidth among all microwave vacuum electron devices (VEDs) and it usually acts as a high power amplifier in communication satellites, radar systems and electronic countermeasures (ECM). Apart from the wide bandwidth, TWTs also display the advantages of high efficiency, high linearity, low noise, and high gain in compact packages. The working frequency of TWTs can be from below 1 GHz to hundreds of GHz and are being developed to beyond 1 THz. The output power of normal TWTs may vary between several watts to hundreds of kilowatts. For pulse operation, the peak power of the TWTs may even reach megawatts levels. The efficiency of the TWTs may range from about 30% to about 70%

With relatively minor changes in the operating parameters, a TWT may work as an oscillator instead of an amplifier. Such a device is referred to as a backward-wave oscillator (BWO) and the oscillation frequency may be tuned by varying the acceleration voltage of electrons within the TWT.

The TWT generally includes an electromagnetic waveguide structure. The speed of an electron beam is much slower than the phase velocity in most typical electromagnetic waveguide structures. In order to have "velocity synchronism", a waveguide structure is needed to slow down the wave speed and such a waveguide structure is referred to as a slow-wave structure (SWS). Commonly used SWSs may include, for example, helix transmission line, coupled cavity, ladder circuits, gratings, helical waveguides and dielectric-lined circuits.

As the operating frequency increases to millimeter wave or terahertz range, the physical dimensions of the various parts of TWTs become smaller and smaller. As a result, traditional fabrication processes can no longer achieve the required accuracy. As a solution to this problem, microfabrication techniques have been proposed in the recent years.

Circular helix slow-wave structure (SWS) has been widely used in travelling-wave tubes (TWTs) due to its wide bandwidth and high coupling impedance. The helix is usually supported by dielectric rods with high thermal conductivity to dissipate the heat from the helix. Normally, the magnetic focusing in the TWT prevents the axially flowing electrons from spreading in the radial direction, but some challenges such as inadequate focusing magnetic field and/or misalignment of the electron gun (e.g., off-axis or inclined with respect to the axis) may cause the electrons to hit the surrounding structure. The charge of the electrons that land on the metallic SWS is conducted away. However, the charge of the electrons that land on the dielectric rods may accumulate on the dielectric rods and may cause a voltage difference between the SWS and the dielectric support material. This voltage may be considerably high to a level causing dielectric breakdown. Even otherwise, a high voltage on the dielectric will affect the electron motion, leading to defocusing of the electron beam and in turn causing more electrons to hit the structure. This problem becomes more severe at millimeter-wave or terahertz frequencies where precise alignment of various parts of the TWT and good control of the magnetic field are more difficult to achieve.

Some methods have been proposed to address the problem of dielectric charging. For example, one method includes coating the dielectric with a thin layer of conductive material. However, the thickness of the coating has been found to be difficult to control and may induce excessive RF loss in the circuits. In another method, coating the dielectric with beryllia has been found to have a relatively less dielectric charging effect. However, the problem of dielectric charging may not be completely avoided in some cases. In yet another method, the material of the rods has been replaced by a lossy dielectric material that exhibits a relatively high electrical conductivity at low frequencies; but this may similarly cause high loss at millimeter-wave frequencies.

As such, there is a need for a SWS that is easily microfabricated and at least minimizes dielectric charging losses, thereby addressing at least the above-mentioned problems.

SUMMARY

According to an embodiment, an electron device is provided. The electron device may include a support substrate, a conductive planar slow-wave structure on the support substrate, the conductive planar slow-wave structure being adapted to receive an electromagnetic wave signal for interaction with an electron beam, and a dielectric layer arrangement in between the conductive planar slow-wave structure and the support substrate, the dielectric layer arrangement being arranged on the support substrate at only one or more support substrate portions overlapping with the conductive planar slow-wave structure.

According to an embodiment, a method for manufacturing an electron device is provided. The method may include providing a support substrate, forming a conductive planar slow-wave structure on the support substrate, the conductive planar slow-wave structure being adapted to receive an electromagnetic wave signal for interaction with an electron beam, and forming a dielectric layer arrangement in between the conductive planar slow-wave structure and the support substrate, the dielectric layer arrangement being arranged on the support substrate at only one or more support substrate portions overlapping with the conductive planar slow-wave structure.

BRIEF DESCRIPTION OF THE DRAWINGS

In the drawings, like reference characters generally refer to like parts throughout the different views. The drawings are not necessarily to scale, emphasis instead generally being placed upon illustrating the principles of the invention. In the following description, various embodiments of the invention are described with reference to the following drawings, in which:

FIG. 6A shows a schematic view of a single-layer dielectric charging and discharging model, while

FIG. 8B shows an equivalent circuit of the model of FIG. 8A, while

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

Embodiments described in the context of one of the methods or devices are analogously valid for the other methods or devices. Similarly, embodiments described in the context of a method are analogously valid for a device, and vice versa.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element include a reference to one or more of the features or elements.

In the context of various embodiments, the phrase "at least substantially" may include "exactly" and a reasonable variance.

In the context of various embodiments, the term "about" or "approximately" as applied to a numeric value encompasses the exact value and a reasonable variance.

As used herein, the term "and/or" includes any and all combinations of one or more of the associated listed items.

As used herein, the phrase of the form of "at least one of A or B" may include A or B or both A and B. Correspondingly, the phrase of the form of "at least one of A or B or C", or including further listed items, may include any and all combinations of one or more of the associated listed items.

Figure 1:
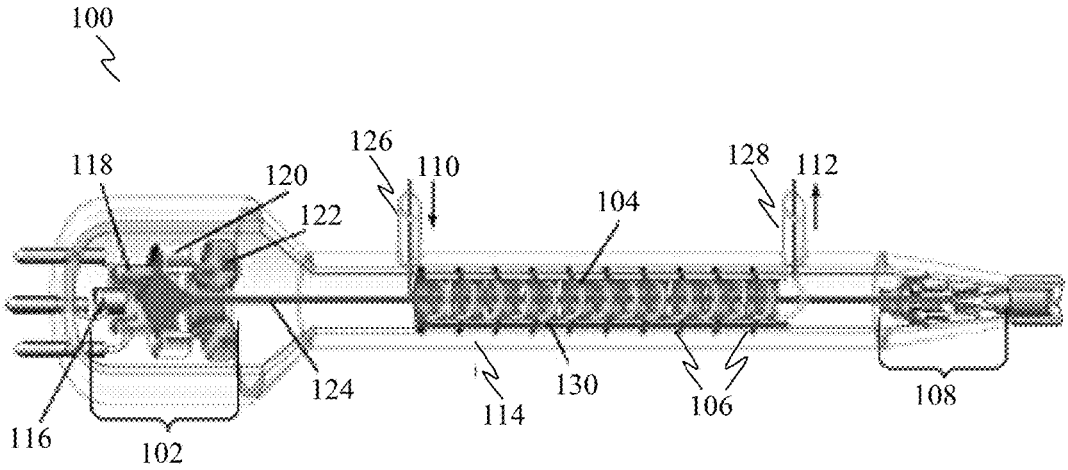
FIG. 1 shows a schematic cross-sectional view of a travelling-wave tube (TWT).

An example of a vacuum electron device (VED) is a travelling wave tube (TWT). A schematic cross-sectional side view of a TWT 100 is shown in FIG. 1. As shown in FIG. 1, the travelling wave tube 100 includes or consists of six parts: an electron gun (or an electron source) 102, a slow-wave structure (SWS) (e.g., a helix) 104, focusing magnets 106, a collector (e.g., a multistage depressed collector) 108, a radio frequency (RF) input 126, a radio frequency (RF) output 128 and a vacuum envelope 114. The electron gun 102 may include a heater 116, an electron-emitting cathode 118, a focus electrode 120, and an anode 122. The electron gun 102 may produce electrons and accelerate the electrons to a certain speed to form an electron beam 124. Low power RF signal 110 may be input into the tube 100 from the RF input port 126. The SWS 104 may slow down the phase velocity of the electromagnetic wave (the RF signal 110). When the electron beam 124 and the electromagnetic wave 110 have similar velocity, the electron beam 124 and the electromagnetic wave 110 may interact with each other. This situation is called "velocity synchronism". During the beam-wave interaction, the electrons may lose energy and an amplified electromagnetic wave (the RF output signal 112) may be obtained at the RF output port 128. The focusing magnets 106 may provide a magnetic field 130 for magnetic focusing, and may be used to counter the effect of repulsive radial space charge forces between the electrons. After passing through the slow-wave structure (SWS) 104, the electrons may still possess some kinetic energy. The collector 108 may be needed to recover the spent electron beam 124 at the end of the TWT 100. The whole structure, including the electron gun 102, the SWS 104 and the collector 108, may be enclosed in an evacuated metal envelope 114.

Figure 2A:
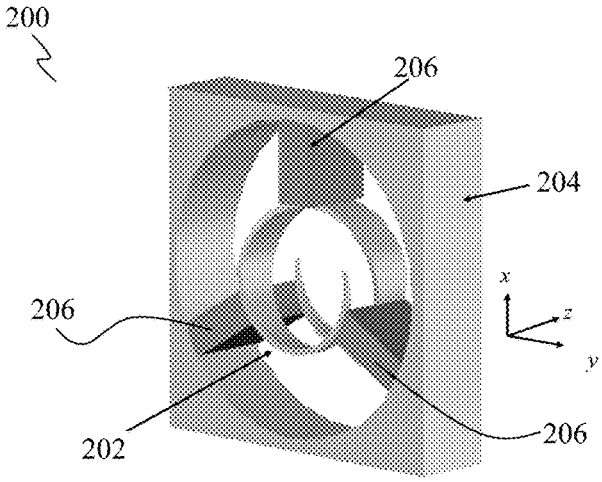
FIG. 2A shows a perspective view of one period of a circular helix slow-wave structure (SWS).

A frequently used SWS may include a circular helix, a perspective view 200 of which illustrating one period is shown in FIG. 2A. As shown in FIG. 2A, the circular helix 202 is placed inside a metal shield 204 and dielectric supporting rods (or stubs) 206 are used in order to fix the helix 202 firmly in the cylindrical metal shield 204. The dielectric rods (or stubs) 206 may have a high thermal conductivity to conduct the heat away from the helix 202. Materials for the rods (or stubs) 206 may include boron nitride (BN) and beryllia (beryllium oxide (BeO)), and in some examples, diamond may also be used.

Figure 2B:
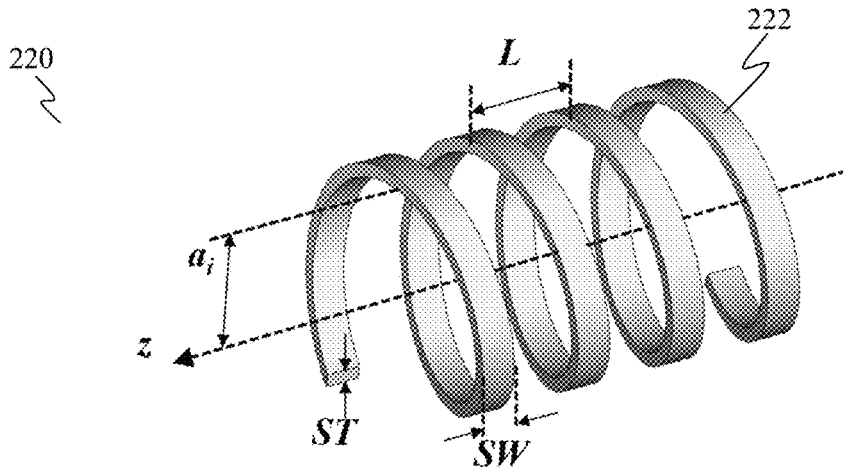
FIG. 2B shows a perspective view of a circular helix slow-wave structure (SWS).

FIG. 2B shows a perspective view 220 illustrating a circular helix SWS 222 made of a conductive strip having multiple periods, L. The circular helix SWS 222 may have a radius of a, relative to the centre of the circular helix 222, as indicated by a directional arrow z. The circular helix 222 may have a strip width, SW, and a strip thickness, ST.

As the operating frequencies increase to millimeter wave or terahertz range, the physical dimensions of the various parts of TWTs may become smaller and smaller. Consequently, conventional fabrication processes may no longer achieve the required accuracy. Microfabrication techniques have been explored as a solution. While the circular helix is the most commonly used SWS, it is not amenable to microfabrication because of the circular shape. In other words, although circular helix SWSs display several advantages, it may be challenging to be microfabricated, at least while maintaining the circular geometry.

A planar slow-wave structure (SWS) may provide an approach to address the challenges associated with the circular helix structure. SWSs such as the rectangular helix, the planar helix with straight-edge connections (PH-SECs), and the microstrip meander line may be employed, which are more amenable to microfabrication.

Figure 3A:
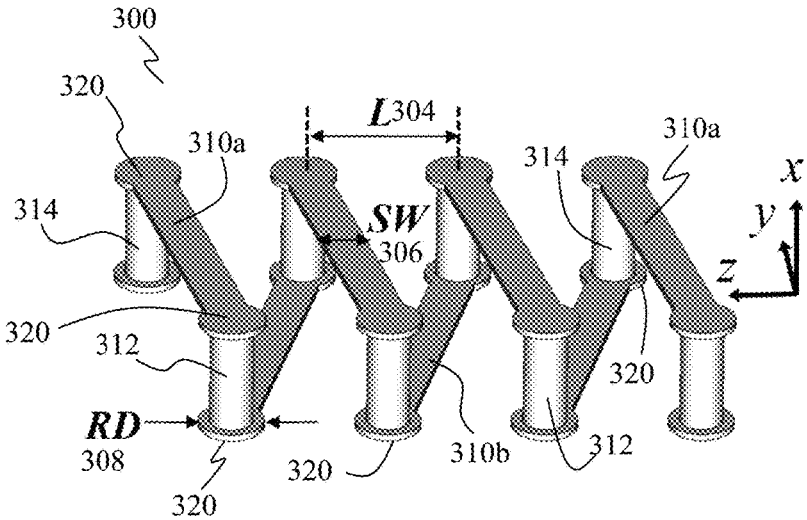
FIGS. 3A and 3B show perspective views of a planar helix slow-wave structure (SWS).

As a non-limiting example, a planar helix with straight edge connections (PH-SEC) 300, as schematically shown in FIG. 3A illustrating a basic configuration, may provide a way to solve the problem associated with the circular helix structure which, as described above, is not amenable to microfabrication. The PH-SEC is a planar version of the circular helix.

In the PH-SEC 300, the top and bottom elements or faces may include or consist of arrays of thin, parallel conductors, e.g., upper conductors 310*a* and lower conductors 310*b*. These conductors 310*a*, 310*b* may be connected on the side with vertical conductors 312, 314. Such a structure may retain the broadband property of the circular helix and it may be suitable for printed circuit or microfabrication techniques due to its planar configuration. Besides, the aspect ratio may be changed for sheet beam applications which may offer higher beam current capacity, decreased beam voltage, lower magnetic field requirement and increased bandwidth.

Opposite ends of each conductor 310*a*, 310*b* may include circular or ring pads 320 connected to the associated vertical conductors 312, 314. Each ring pad 320 may have a diameter, RD 308. Each conductor 310*a*, 310*b* may have a width, SW 306. The conductors 310*a*, 310*b* may have a period, L 304.

Figure 3B:
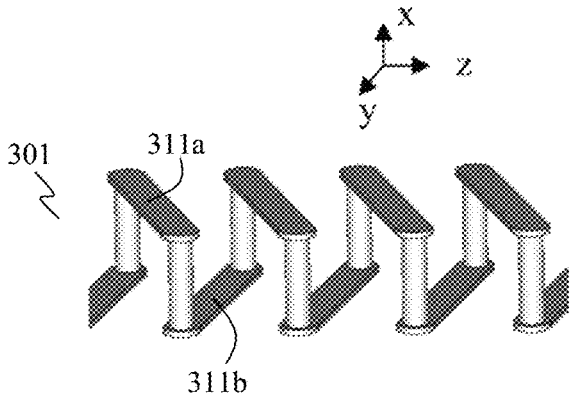

FIG. 3B shows a perspective view of another PH-SEC 301, which is the same as PH-SEC 300 except that the upper conductors 311*a* and lower conductors 311*b* of the PH-SEC 301 may have at least substantially uniform width throughout the length of each conductor 311*a*, 311*b*.

Figure 5A:
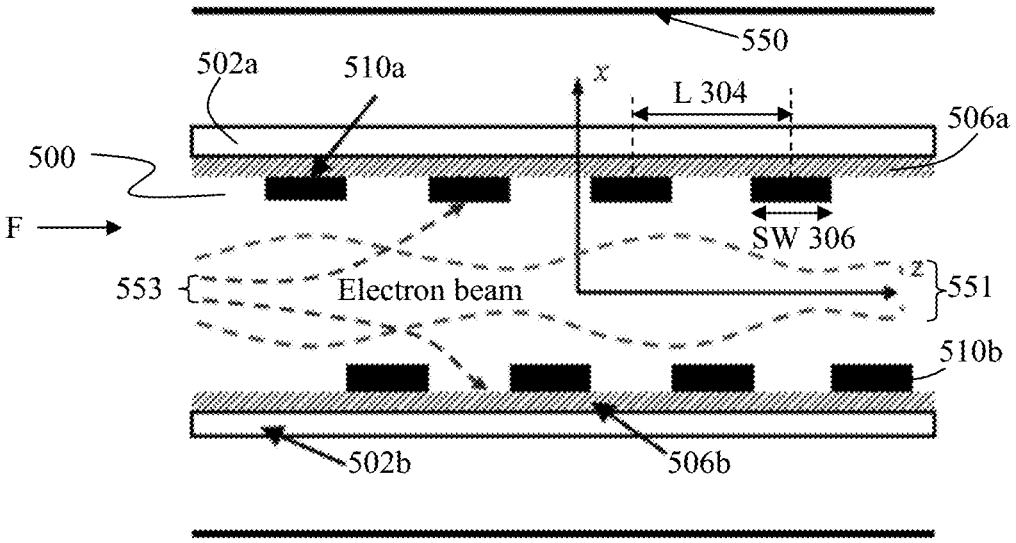
FIG. 5A shows a schematic side view of a symmetric planar helix with straight edge connections (PH-SEC).
Figure 5B:
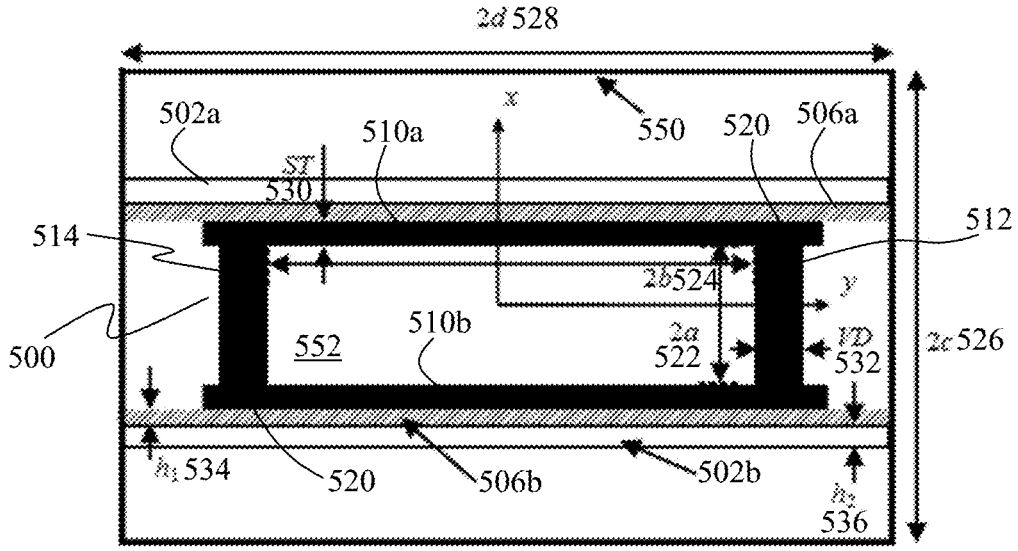
FIG. 5B shows a schematic cross-sectional view of a symmetric planar helix with straight edge connections (PH-SEC).
Figure 5C:
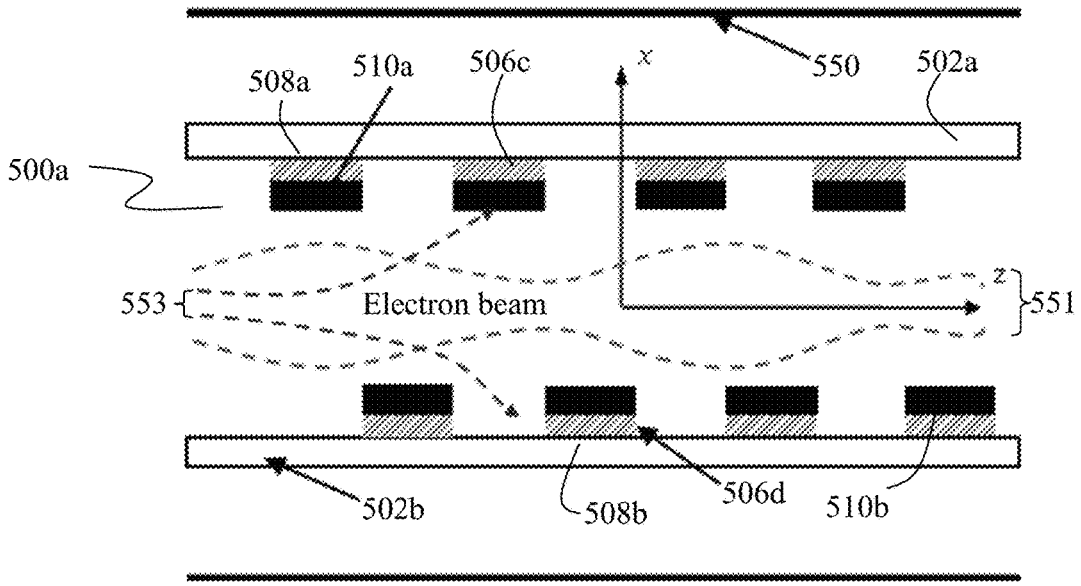
FIG. 5C shows a cross-section view of a modified planar helix with straight edge connections (PH-SEC), according to various embodiments.

The PH-SEC 300, 301 retains the advantages of the circular helix, namely, broad bandwidth and high coupling impedance. It may also provide a potentially better heat dissipation by contacting the dielectric substrates over a large area. Further, it may be fabricated with microfabrication techniques, for example, using silicon (Si), for high-frequency applications and may accommodate a sheet (electron) beam. Practical configuration using dielectric substrates for a PH-SEC may be as illustrated in FIGS. 5A to 5C to be described later below.

The issue of dielectric charging has been a problem in many types of vacuum electronics devices (VEDs) including but not limited to TWTs, which use SWS or dielectric-lined waveguides. For instance, although normally there is magnetic focusing in the TWTs to prevent the electron beam from spreading, many shortcomings such as not strong-enough focusing magnetic field, misalignment of the electron gun with the slow-wave structure (off axis or inclined with axis) may cause the electrons to hit the SWS and the supporting dielectric material, especially when physical dimensions are reduced for high frequency applications. Some of the electrons will land on the SWS where the charge will be conducted away since the SWS is made of a good conductor. However, some of the electrons will land on the dielectric substrate where the SWS is provided on; in this case, the charge due to the electrons accumulates there and causes a voltage difference between the SWS and the dielectric substrate. If this voltage is so high that the dielectric substrate cannot withstand it, the substrate will break down. Even if the voltage is not high enough to cause dielectric breakdown, a high voltage on the substrate is likely to affect the electron stream, defocusing the electron beam and causing more electrons to hit the structure. In the case of the circular helix, the problem mainly comes from the dielectric supporting rods. This problem becomes even more serious for planar structures including but not limited to PH-SEC since there is more dielectric present when printed circuit or microfabrication techniques are applied.

Due to the presence of the dielectric substrates in the PH-SEC, there may be an increased risk of dielectric charging. For instance, consider a Ka-band symmetric PH-SEC configuration, where such a structure, instead of using a dielectric substrate only on one side, uses two dielectric substrates making the structure symmetric with respect to the yz plane to reduce mode competition and increase gain.

Various embodiments may provide a solution for dielectric charging problem for waveguide structures for vacuum electron devices (VEDs).

Various embodiments may provide a microfabricated planar helix slow-wave structure (SWS) to avoid dielectric charging in travelling-wave tubes (TWTs).

Figure 4A:
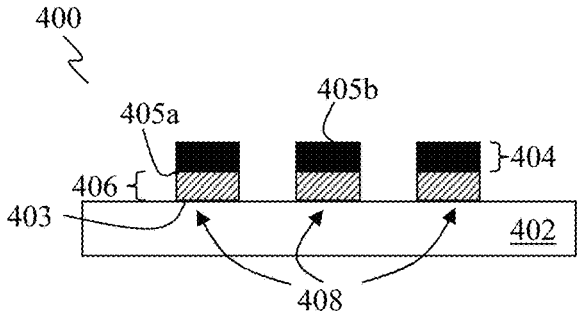
FIG. 4A shows a partial schematic cross-sectional view of an electron device, according to various embodiments.

FIG. 4A shows a partial schematic cross-sectional view of an electron device 400, according to various embodiments. The electron device 400 includes a support substrate 402, a conductive planar slow-wave structure 404 on the support substrate 402, the conductive planar slow-wave structure 404 being adapted to receive an electromagnetic wave signal for interaction with an electron beam, and a dielectric layer arrangement 406 in between the conductive planar slow-wave structure 404 and the support substrate 402, the dielectric layer arrangement 406 being arranged on the support substrate 402 at only one or more support substrate portions 408 overlapping with the conductive planar slow-wave structure 404.

In other words, an electron device 400 may be provided, having a support substrate (e.g., at least one support substrate) or a carrier 402 and a conductive planar slow-wave structure (SWS) 404 that may be supported on the support substrate 402. The conductive planar slow-wave structure 404 may receive an electromagnetic wave (EM) signal (e.g., a radio frequency (RF signal)) which may propagate through the conductive planar SWS 404. The EM signal may interact with an electron beam propagating adjacent to or in the vicinity of the conductive planar SWS 404. The electron device 400 may further include a dielectric layer (or insulating layer) arrangement 406 sandwiched in between the conductive planar SWS 404 and the support substrate 402. The dielectric layer arrangement 406 may be arranged non-uniformly on the support substrate 402 such that the dielectric layer arrangement 406 may be provided at only one or more (or all) support substrate portions 408 that overlap with the conductive planar SWS 404. This may mean that the one or more support substrate portions 408 may overlap with the conductive planar SWS 404, and the dielectric layer arrangement 406 may be provided on the one or more support substrate portions 408 only. In other words, the dielectric layer arrangement 406 may be arranged only on the support substrate 402 or on the one or more support substrate portions 408 (directly) beneath the conductive planar SWS 404. Further, this may mean that portion(s) of the support substrate 402 not overlapping with the conductive planar SWS 404 may be free of the dielectric layer arrangement 406.

It should be appreciated that the one or more support substrate portions 408 are part of the support substrate 402. In other words, the one or more support substrate portions 408 refer to one or more portions of the support substrate 402.

The dielectric layer arrangement 406 may be arranged non-uniformly on the support substrate 402 such that the dielectric layer arrangement 406 is provided only at the support substrate portion(s) 408. This may mean that the dielectric layer arrangement 406 may not be provided over the entire support substrate 402 or the entire surface 403 of the support substrate 402 facing the conductive planar SWS 404.

In various embodiments, the dielectric layer arrangement 406 may be arranged on the support substrate 402 at only one or more (or all) support substrate portions 408 that overlap with a surface (e.g., outer surface) 405*a* of the conductive planar SWS 404 that faces the support substrate 402. The dielectric layer arrangement 406 may be arranged in between the support substrate 402 and the surface 405*a* of the SWS 404 facing the support substrate 402.

In various embodiments, the dielectric layer arrangement 406 may be arranged on the side of the surface (e.g., outer surface) 405*a* of the SWS 404 facing the support substrate 402. The dielectric layer arrangement 406 may be arranged only on the side of the surface (e.g., outer surface) 405*a* of the SWS 404 facing the support substrate 402. This may mean that other surfaces (e.g., inner surface 405*b* and side surfaces) of the SWS 404 not facing the support substrate 402 may be free of the dielectric layer arrangement 406.

In various embodiments, the dielectric layer arrangement 406 may overlap with the conductive planar SWS 404 and the support substrate 402. The dielectric layer arrangement 406 may overlap with at least a portion of or the entire conductive planar SWS 404 and the support substrate portion(s) 408. The dielectric layer arrangement 406, the conductive planar SWS 404 and the support substrate 402 (or the support substrate portion(s) 408) may be arranged coaxially, for example, along an axis in the vertical or height direction of the conductive planar SWS 404.

In various embodiments, the dielectric layer arrangement 406 may be provided (entirely) within the boundary of the conductive planar SWS 404.

In various embodiments, the conductive planar SWS 404 may include one or more elements or members that is planar or has a planar geometry. The conductive planar SWS 404 may be amenable to fabrication using a microfabrication technique.

In the context of various embodiments, the conductive planar slow-wave structure (SWS) 404 may be a dielectric loaded slow-wave structure.

In the context of various embodiments, the conductive planar slow-wave structure (SWS) 404 may act as a waveguide or waveguiding structure, e.g., an electromagnetic waveguiding structure. The SWS 404 may be a dielectric loaded waveguide structure.

In the context of various embodiments, the conductive planar slow-wave structure (SWS) 404 may act to slow down (or decrease) the phase velocity of the electromagnetic wave signal. When the electron beam and the electromagnetic wave signal have similar velocity, the electron beam and the electromagnetic wave signal may interact with each other. This situation is called "velocity synchronism". During the beam-wave interaction, the electrons lose energy and an amplified electromagnetic wave may be consequently obtained. This may mean that energy may be transferred from the electron beam to the electromagnetic wave signal.

In the context of various embodiments, the electron beam may be a cylindrical electron beam (e.g., having a circular cross-section) or a sheet-like (or planar) electron beam.

In the context of various embodiments, the electromagnetic wave signal may be a radio frequency (RF) signal.

In various embodiments, an input port (e.g., an RF input port) may be coupled to the SWS 404 through which the electromagnetic wave signal may be received by the SWS 404. An output port (e.g., an RF output port) may be coupled to the SWS 404 through which the electromagnetic wave signal, after passing through the SWS 404, may be outputted. In this way, the electromagnetic wave signal, after interaction with the electron beam, (or in other words, the amplified electromagnetic wave signal) may be outputted from the electron device 400.

In various embodiments, the dielectric layer arrangement 406 may contact the conductive planar SWS 404. The dielectric layer arrangement 406 may contact the surface (e.g., outer surface) 405*a* of the SWS 404 facing the support substrate 402. In various embodiments, the dielectric layer arrangement 406 may contact only the (entire) surface 405*a* of the conductive planar SWS 404 facing the support substrate 402. This may mean that other surfaces (e.g., surface 405*b* and side surfaces) of the SWS 404 not facing the support substrate 402 may not contact the dielectric layer arrangement 406. In various embodiments, the dielectric layer arrangement 406 may also contact the one or more (or all) support substrate portions 408 that overlap with the conductive planar SWS 404.

In various embodiments, the support substrate 402 may include dopants (e.g., dopant atoms). Incorporating dopants into the support substrate 402 may change or increase the conductivity of the support substrate 402. Dopants may be of p-type or n-type. In various embodiments, the dopants may include arsenic (As), boron (B) or phosphorous (P), for example, for embodiments where the support substrate 402 is made of silicon (Si).

Figure 4B:
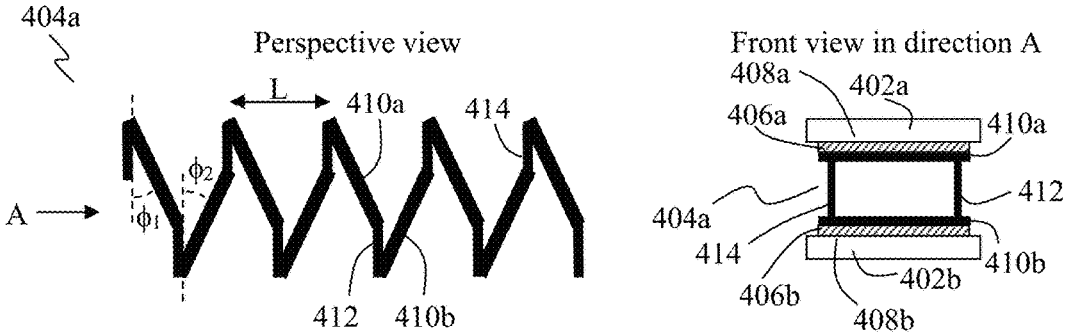
FIGS. 4B to 4D show schematic views of conductive planar slow wave structures, according to various embodiments.

In the context of various embodiments, the conductive planar slow wave structure (SWS) 404 may include a planar helix structure 404*a* as shown in FIG. 4B. For clarity and ease of understanding, the support substrate 402 and the dielectric layer arrangement 406 are not shown in the perspective view. The planar helix structure 404*a* may include a plurality of first elements 410*a* on a first portion (e.g., upper portion or upper substrate) 402*a* of the support substrate 402, a plurality of second elements 410*b* on a second portion (e.g., lower portion or lower substrate) 402*b* of the support substrate 402, wherein the plurality of first elements 410*a* and the plurality of second elements 410*b* may be arranged one over the other, and a plurality of connectors (as represented by 412, 414 for two such connectors), each respective connector 412, 414 of the plurality of connectors 412, 414 may be arranged to connect an end region of an associated first element 410*a* of the plurality of first elements 410*a* to an end region of an associated second element 410*b* of the plurality of second elements 410*b*, and the dielectric layer arrangement 406 may include a first dielectric layer 406*a* in between the plurality of first elements 410*a* and the first portion 402*a* of the support substrate 402, the first dielectric layer 406*a* being arranged (non-uniformly) on the first portion 402*a* of the support substrate 402 at only one or more (or all) support substrate portions 408*a* overlapping with the plurality of first elements 410*a*, and a second dielectric layer 406*b* in between the plurality of second elements 410*b* and the second portion 402*b* of the support substrate 402, the second dielectric layer 406*b* being arranged (non-uniformly) on the second portion 402*b* of the support substrate 402 at only one or more (or all) support substrate portions 408*b* overlapping with the plurality of second elements 410*b*. The associated first element 410*a* and the associated second element 410*b* connected by the respective connector 412, 414 may be sequential or successive elements.

The planar helix structure 404*a* may be similar to the PH-SEC of FIG. 3A or 3B.

The plurality of first elements 410*a* and the plurality of second elements 410*b* may be conductor strips (or conductive strips) or metal strips.

In various embodiments, the plurality of first elements 410*a* and the plurality of second elements 410*b* may be planar. The plurality of connectors 412, 414 may be cylindrical.

The plurality of first elements 410*a* may be arranged parallel to each other. The plurality of second elements 410*b* may be arranged parallel to each other.

In various embodiments, the plurality of first elements 410*a* may be vertically offset from the plurality of second elements 410*b*. The plurality of first elements 410*a* may be arranged along a first plane while the plurality of second elements 410*b* may be arranged along a second plane, wherein the first plane and the second plane may be located one over the other. The first plane and the second plane may be spaced apart from each other, where the spacing may be defined by the length of the respective connector 412, 414. The first plane and the second plane may be vertically offset from each other. In various embodiments, the electron beam may propagate through and between the first plane and the second plane.

In various embodiments, the plurality of first elements 410*a* may be arranged facing the plurality of second elements 410*b*. This may mean that respective inner surfaces of the plurality of first elements 410*a* and the plurality of second elements 410*b* may be arranged facing each other. The outer surfaces of the plurality of first elements 410*a* may be arranged facing the first portion 402*a* of the support substrate 402. The outer surfaces of the plurality of second elements 410*b* may be arranged facing the second portion 402*b* of the support substrate 402.

In various embodiments, the plurality of first elements 410*a* may be arranged asymmetrically relative to the plurality of second elements 410*b*.

In various embodiments, the plurality of first elements 410*a* and the plurality of second elements 410*b* may be inclined at symmetric angles of opposite signs. This may mean that the plurality of first elements 410*a* may be inclined at a first angle, $\phi_1$, and the plurality of second elements 410*b* may be inclined at a second angle, $\phi_2$, the first angle and the second angle having the same magnitude but opposite signs, e.g., $\phi_1=-\phi_2$.

In various embodiments, the plurality of first elements 410*a* and the plurality of second elements 410*b* may define a zig zag pattern.

In various embodiments, the plurality of connectors 412, 414 may be vertical connectors (or vertical conductors). This may mean that a longitudinal axis of each connector 412, 414 may be at least substantially perpendicular to at least one of a longitudinal axis of the associated first element 410*a* or a longitudinal axis of the associated second element 410*b*. In this way, the planar helix structure 404*a* may be a planar helix with straight-edge connections (PH-SECs).

In the context of various embodiments, the period, L, of the plurality of first elements 410*a* and/or of the plurality of second elements 410*b* (or distance between adjacent first elements 410*a* or between adjacent second elements 410*b*) may be in the range of between about 30 μm and about 10,000 μm, for example, depending on the frequency range of operation. As non-limiting examples, the period, L, may be between about 30 μm and about 5,000 μm, between about 30 μm and about 1,000 μm, between about 30 μm and about 500 μm, between about 500 μm and about 10,000 μm, between about 1,000 μm and about 10,000 μm, or between about 100 μm and about 500 μm.

In the context of various embodiments, each first element 410*a* and/or each second element 410*b* may have a width, SW, in the range of between about 15 μm and about 5000 μm, for example, depending on the frequency range of operation. As non-limiting examples, the width, SW, may be between about 15 μm and about 3000 μm, between about 15 μm and about 1000 μm, between about 15 μm and about 100 μm, between about 500 μm and about 3000 μm, between about 1000 μm and about 3000 μm, or between about 100 μm and about 500 μm.

In the context of various embodiments, each first element 410*a* and/or each second element 410*b* may have a thickness, ST, in the range of between about 7 μm and about 10 μm, for example, depending on the frequency range of operation. As non-limiting examples, the thickness, ST, may be between about 7 μm and about 8 μm, or between about 8 μm and about 10 μm.

In the context of various embodiments, each connector 412, 414 may have a cross-sectional dimension or diameter, VD, in the range of between about 10 μm and about 3000 μm, for example, depending on the frequency range of operation. As non-limiting examples, the cross-sectional dimension or diameter, VD, may be between about 10 μm and about 1000 μm, between about 10 μm and about 500 μm, between about 500 μm and about 3000 μm, between about 1000 μm and about 3000 μm, between about 500 μm and about 1000 μm, or between about 100 μm and about 500 μm.

In various embodiments, each of the end region of the associated first element 410*a* and the end region of the associated second element 410*b* may include a circular pad connected to the respective connector 412, 414. A cross-sectional dimension (or diameter), RD, of the circular pad may be larger than a cross-sectional dimension (or diameter), VD, of the respective connector 412, 414.

In the context of various embodiments, the circular pad may have a cross-sectional dimension or diameter, RD, in the range of between about 15 μm and about 5000 μm, for example, depending on the frequency range of operation. As non-limiting examples, the cross-sectional dimension or diameter, RD, may be between about 15 μm and about 3000 μm, between about 15 μm and about 1000 μm, between about 15 μm and about 500 μm, between about 500 μm and about 5000 μm, between about 1000 μm and about 5000 μm, or between about 100 μm and about 500 μm.

In the context of various embodiments, a number, N, of the periods or turns of the planar helix structure 404*a* may be in the range of between about 20 and about 300, for example, depending on the frequency range of operation. As non-limiting examples, the number, N, may be between about 20 and about 200, between about 20 and about 100, between about 20 and about 50, between about 100 and about 300, between about 100 and about 200, or between about 50 and about 100.

In the context of various embodiments, the planar helix structure 404*a* may define an electron beam tunnel. The electron beam may propagate within and through the electron beam tunnel.

In the context of various embodiments, the distance, 2a, between the respective planes of the inner surfaces of the plurality of first elements 410*a* and the plurality of second elements 410*b* (or height of the electron beam tunnel) may be in the range of between about 30 μm and about 10,000 μm, for example, depending on the frequency range of operation. As non-limiting examples, the distance, 2a, may be between about 30 μm and about 5,000 μm, between about 30 μm and about 1,000 μm, between about 30 μm and about 500 μm, between about 500 μm and about 10,000 μm, between about 1,000 μm and about 10,000 μm, or between about 100 μm and about 500 μm.

In the context of various embodiments, the distance, 2b, between the respective planes of the inner surfaces of the vertical connectors 412, 414 (or width of the electron beam tunnel) may be in the range of between about 70 μm and about 22,000 μm, for example, depending on the frequency range of operation. As non-limiting examples, the distance, 2b, may be between about 70 μm and about 20,000 μm, between about 70 μm and about 10,000 μm, between about 70 μm and about 1,000 μm, between about 1000 μm and about 22,000 μm, between about 10,000 μm and about 20,000 μm, or between about 500 μm and about 1,000 μm.

In the context of various embodiments, the planar helix structure 404*a* may define a planar version of a circular helix.

In the context of various embodiments, the conductive planar slow wave structure (SWS) 404 may include a meander line structure, for example, a single meander line structure.

Figure 4C:
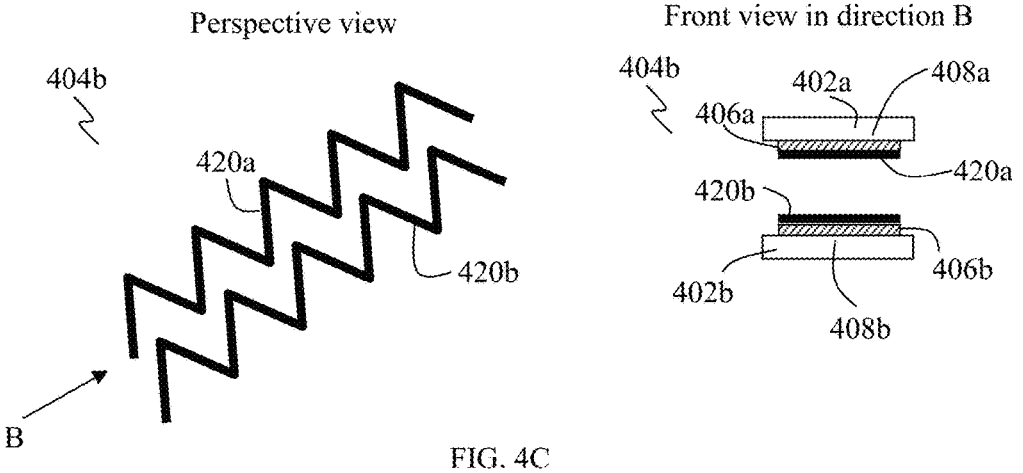

In the context of various embodiments, the conductive planar slow wave structure (SWS) 404 may include a meander line structure 404*b* as shown in FIG. 4C. For clarity and ease of understanding, the support substrate 402 and the dielectric layer arrangement 406 are not shown in the perspective view. The meander line structure 404*b* may include a first meander line element 420*a* on a first portion (e.g., upper portion or upper substrate) 402*a* of the support substrate 402, and a second meander line element 420*b* on a second portion (e.g., lower portion or lower substrate) 402*b* of the support substrate 402, wherein the first meander line element 420*a* and the second meander line element 420*b* may be arranged one over the other and spaced apart from each other, and the dielectric layer arrangement 406 may include a first dielectric layer 406*a* in between the first meander line element 420*a* and the first portion 402*a* of the support substrate 402, the first dielectric layer 406*a* being arranged (non-uniformly) on the first portion 402*a* of the support substrate 402 at only one or more (or all) support substrate portions 408*a* overlapping with the first meander line element 420*a*, and a second dielectric layer 406*b* in between the second meander line element 420*b* and the second portion 402*b* of the support substrate 402, the second dielectric layer 406*b* being arranged (non-uniformly) on the second portion 402*b* of the support substrate 402 at only one or more (or all) support substrate portions 408*b* overlapping with the second meander line element 420*b*.

In various embodiments, the first meander line element 420*a* and the second meander line element 420*b* may be planar.

In various embodiments, the entire first meander line element 420*a* and the entire second meander line element 420*b* may be arranged spaced apart from each other. In various embodiments, the entire first meander line element 420*a* and the entire second meander line element 420*b* may be vertically offset from each other.

In various embodiments, the first meander line element 420*a* and the second meander line element 420*b* may be arranged facing each other. This may mean that respective inner surfaces of the first meander line element 420*a* and the second meander line element 420*b* may be arranged facing each other. The outer surface of the first meander line element 420*a* may be arranged facing the first portion 402*a* of the support substrate 402. The outer surface of the second meander line element 420*b* may be arranged facing the second portion 402*b* of the support substrate 402.

In various embodiments, the first meander line element 420*a* and the second meander line element 420*b* may be arranged symmetrically relative to each other. This may mean that the first meander line element 420*a* and the second meander line element 420*b* may be mirror images of each other about a plane located in between the first meander line element 420*a* and the second meander line element 420*b*.

In various embodiments, each period of the first meander line element 420*a* and each period of the second meander line element 420*b* may be V-shaped or U-shaped.

In various embodiments, the electron beam may propagate through and between the first meander line element 420*a* and the second meander line element 420*b*.

Figure 4D:
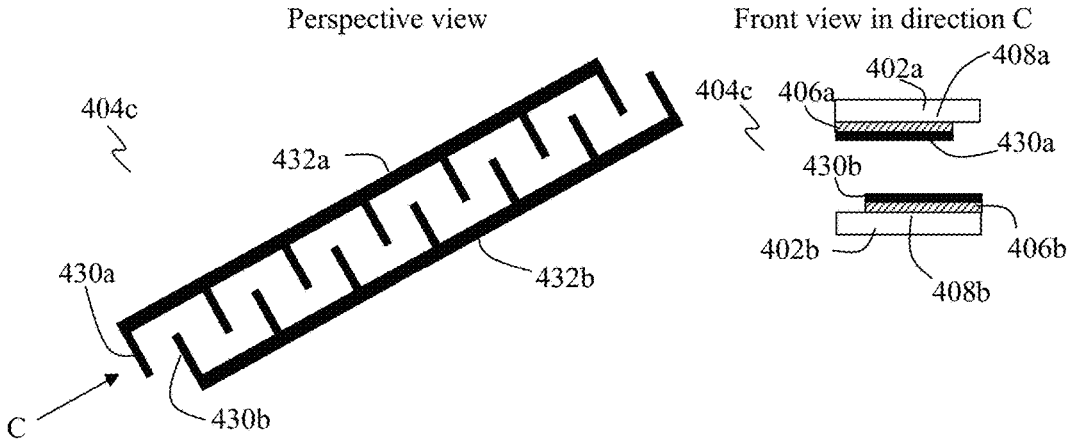

In the context of various embodiments, the conductive planar slow wave structure (SWS) 404 may include an interdigitated structure 404*c* as shown in FIG. 4D. For clarity and ease of understanding, the support substrate 402 and the dielectric layer arrangement 406 are not shown in the perspective view. The interdigitated structure 404*c* may include a plurality of first interdigital elements (or fingers) 430*a* on a first portion 402*a* of the support substrate 402, the plurality of first interdigital elements 430*a* being coupled to each other (e.g., via a first coupling structure 432*a*), and a plurality of second interdigital elements (or fingers) 430*b* on a second portion 402*b* of the support substrate 402, the plurality of second interdigital elements 430*b* being coupled to each other (e.g., via a second coupling structure 432*b*), wherein the plurality of first interdigital elements 430*a* and the plurality of second interdigital elements 430*b* may be arranged one over the other and interdigitated with each other, and the dielectric layer arrangement 406 may include a first dielectric layer 406*a* in between the plurality of first interdigital elements 430*a* and the first portion 402*a* of the support substrate 402, the first dielectric layer 406*a* being arranged (non-uniformly) on the first portion 402*a* of the support substrate 402 at only one or more (or all) support substrate portions 408*a* overlapping with the plurality of first interdigital elements 430*a*, and a second dielectric layer 406*b* in between the plurality of second interdigital elements 430*b* and the second portion 402*b* of the support substrate 402, the second dielectric layer 406*b* being arranged (non-uniformly) on the second portion 402*b* of the support substrate 402 at only one or more (or all) support substrate portions 408*b* overlapping with the plurality of second interdigital elements 430*b*.

In various embodiments, the plurality of first interdigital elements 430*a* and the plurality of second interdigital elements 430*b* may be planar.

In various embodiments, the plurality of first interdigital elements 430*a* may be vertically offset from the plurality of second interdigital elements 430*b*. The plurality of first interdigital elements 430*a* may be arranged along a first plane while the plurality of second interdigital elements 430*b* may be arranged along a second plane, wherein the first plane and the second plane may be located one over the other. The first plane and the second plane may be spaced apart from each other. The first plane and the second plane may be vertically offset from each other. In various embodiments, the electron beam may propagate through and between the first plane and the second plane.

In various embodiments, the plurality of first interdigital elements 430*a* may be arranged facing the plurality of second interdigital elements 430*b*. This may mean that respective inner surfaces of the plurality of first interdigital elements 430*a* and the plurality of second interdigital elements 430*b* may be arranged facing each other. The outer surfaces of the plurality of first interdigital elements 430*a* may be arranged facing the first portion 402*a* of the support substrate 402. The outer surfaces of the plurality of second interdigital elements 430*b* may be arranged facing the second portion 402*b* of the support substrate 402.

In various embodiments, each of the plurality of first interdigital elements 430*a* and the plurality of second interdigital elements 430*b* may be quadrilaterally-shaped, for example, in the form of a rectangle or a square.

In the context of various embodiments, the first portion 402*a* and the second portion 402*b* may be individual or separate substrates. This may mean that the first portion 402*a* may be a first substrate (e.g., an upper substrate) while the second portion 402*b* may be a separate second substrate (e.g., a lower substrate).

In various embodiments, the dielectric constant of the dielectric layer arrangement 406 may be lower than the dielectric constant of the support substrate 402.

In the context of various embodiments, the dielectric layer arrangement 406 may have a dielectric constant in the range of between about 2 and about 10, for example, between about 2 and about 7, between about 2 and about 5, between about 5 and about 10, or between about 3 and about 5.

In the context of various embodiments, the support substrate may have a dielectric constant in the range of between about 3 and about 15, for example, between about 3 and about 10, between about 3 and about 5, between about 5 and about 15, or between about 5 and about 10.

In various embodiments, an electrical conductivity of the dielectric layer arrangement 406 may be lower than an electrical conductivity of the support substrate 402. Conversely, this may mean that a resistivity of the dielectric layer arrangement 406 may be higher than a resistivity of the support substrate 402.

In the context of various embodiments, the dielectric layer arrangement 406 may have an electrical conductivity lower than about $10^{-4}$ S/m, for example, lower than about $10^{-5}$ S/m, or lower than about $10^{-6}$ S/m.

In the context of various embodiments, the support substrate may have an electrical conductivity in the range of between about $10^{-4}$ S/m and about 1 S/m, for example, between about $10^{-4}$ S/m and about $10^{-1}$ S/m, between about $10^{-4}$ S/m and about $10^{-2}$ S/m, between about $10^{-3}$ S/m and about 1 S/m, or between about $10^{-3}$ S/m and about $10^{-1}$ S/m.

In various embodiments, the electron device 400 may further include a metallic enclosure arranged to surround the conductive planar slow-wave structure 404. The metallic enclosure may surround the entire conductive planar slow-wave structure 404. The metallic enclosure may surround the (entire) support substrate 402 and the (entire) dielectric layer arrangement 406.

In the context of various embodiments, the metallic enclosure may have a height, 2c, in the range of between about 50 μm and about 20,000 μm, for example, depending on the frequency range of operation. As non-limiting examples, the height, 2c, may be between about 50 μm and about 10,000 μm, between about 50 μm and about 1,000 μm, between about 1,000 μm and about 20,000 μm, between about 10,000 μm and about 20,000 μm, or between about 5,000 μm and about 10,000 μm.

In the context of various embodiments, the metallic enclosure may have a width, 2d, in the range of between about 250 μm and about 100,000 μm, for example, depending on the frequency range of operation. As non-limiting examples, the width, 2d, may be between about 250 μm and about 50,000 μm, between about 250 μm and about 10,000 μm, between about 250 μm and about 1,000 μm, between about 10,000 μm and about 100,000 μm, between about 50,000 μm and about 100,000 μm, or between about 1,000 μm and about 50,000 μm.

In various embodiments, the electron device 400 may further include an electron source configured to generate the electron beam. The electron source may include an electron gun and the associated electrodes.

In the context of various embodiments, the electron device 400 may be or may include a travelling-wave tube (TWT).

In the context of various embodiments, the conductive planar slow-wave structure 404 is a conductor or includes a conductive material, for example, the conductive planar slow-wave structure 404 may include a metal.

In the context of various embodiments, the dielectric layer arrangement 406 may include at least one of silicon oxide ($SiO_2$), boron nitride (BN), beryllia (or beryllium oxide (BeO)) or diamond. However, it should be appreciated that other dielectric materials may be used.

In the context of various embodiments, the support substrate 402 may include a semiconductor or a dielectric material. The support substrate 402 may include at least one of silicon (Si), germanium (Ge), gallium arsenide (GaAs) or indium phosphide (InP). However, it should be appreciated that other materials may be used.

In the context of various embodiments, the dielectric layer arrangement 406 and the support substrate 402 may be made of different materials.

In the context of various embodiments, the conductive planar slow-wave structure 404 may be supported on at least two layers of dielectric materials, in the form of the dielectric layer arrangement 406 and a dielectric support substrate 402.

In the context of various embodiments, the dielectric layer arrangement 406 may have a thickness, h1, in the range of between about 1 μm and about 15 μm, for example, depending on the frequency range of operation. As non-limiting examples, the thickness, h1, may be between about 1 μm and about 10 μm, between about 1 μm and about 5 μm, between about 5 μm and about 15 μm, or between about 5 μm and about 10 μm.

In the context of various embodiments, the support substrate 402 may have a thickness, h2, in the range of between about 10 μm and about 600 μm depending on the frequency range of operation. As non-limiting examples, the thickness, h2, may be between about 10 μm and about 300 μm, between about 10 μm and about 100 μm, between about 100 μm and about 600 μm, between about 200 μm and about 600 μm, between about 200 μm and about 400 μm, or between about 100 μm and about 200 μm.

In the context of various embodiments, the travelling-wave tube (TWT) or the electron device 400 may function as an amplifier or an oscillator (e.g., a backward-wave oscillator (BWO)) or a gyro-TWT or a conductive planar slow-wave cyclotron amplifier.

In the context of various embodiments, the electron device 400 may be a vacuum electron device (VED) or a vacuum electronic device. This may mean that the electron device 400 may include a vacuum enclosure, for example, the conductive planar slow-wave structure 404, the support substrate 402 and the dielectric layer arrangement 406 may be arranged within the vacuum enclosure.

In the context of various embodiments, the electron device 400 may be aimed at applications as a microwave, millimeter wave or terahertz vacuum electronics device.

In the context of various embodiments, the electron device 400 may minimize or avoid dielectric charging problem. This may be due to the arrangement of the conductive planar slow-wave structure 404, the support substrate 402 and the dielectric layer arrangement 406 of the electron device 400.

In the context of various embodiments, the electron device 400 may define a modified planar helix with straight-edge connections (PH-SEC).

Figure 4E:
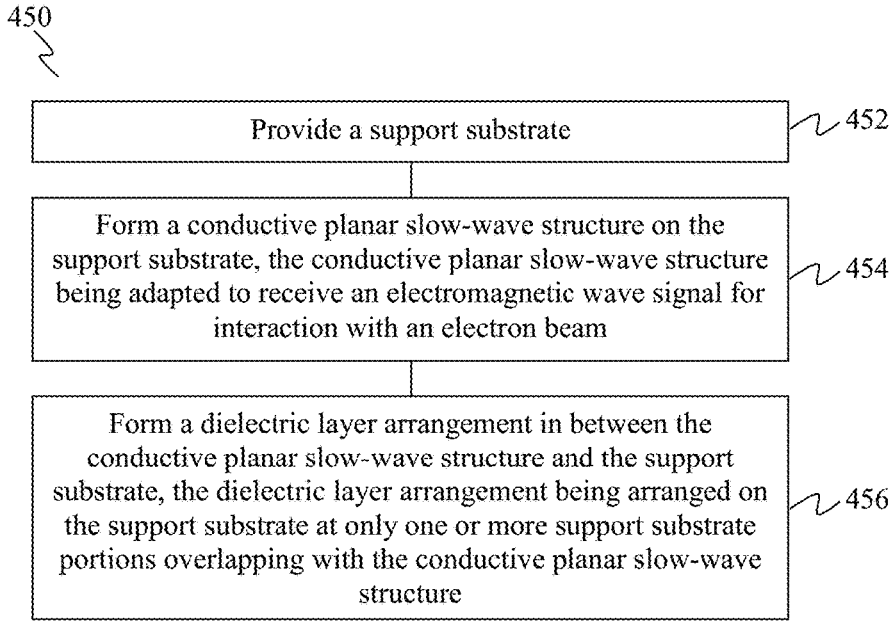
FIG. 4E shows a flow chart illustrating a method for manufacturing an electron device, according to various embodiments.

FIG. 4E shows a flow chart 450 illustrating a method for manufacturing an electron device, according to various embodiments.

At 452, a support substrate is provided.

At 454, a conductive planar slow-wave structure is formed on the support substrate, the conductive planar slow-wave structure being adapted to receive an electromagnetic wave signal for interaction with an electron beam.

At 456, a dielectric layer arrangement is formed in between the conductive planar slow-wave structure and the support substrate, the dielectric layer arrangement being arranged on the support substrate at only one or more support substrate portions overlapping with the conductive planar slow-wave structure.

In various embodiments, the method may further include doping the support substrate with dopants.

In various embodiments, the planar slow wave structure may include a planar helix structure. At 454, when forming the conductive planar slow-wave structure, in the form of a planar helix structure, a plurality of first elements may be formed on a first portion of the support substrate, a plurality of second elements may be formed on a second portion of the support substrate, wherein the plurality of first elements and the plurality of second elements may be arranged one over the other, and a plurality of connectors may be formed, each respective connector of the plurality of connectors may be arranged to connect an end region of an associated first element of the plurality of first elements to an end region of an associated second element of the plurality of second elements. At 456, when forming the dielectric layer arrangement, a first dielectric layer may be formed in between the plurality of first elements and the first portion of the support substrate, the first dielectric layer being arranged on the first portion of the support substrate at only one or more support substrate portions overlapping with the plurality of first elements, and a second dielectric layer may be formed in between the plurality of second elements and the second portion of the support substrate, the second dielectric layer being arranged on the second portion of the support substrate at only one or more support substrate portions overlapping with the plurality of second elements.

In various embodiments, the planar slow wave structure may include a meander line structure.

In various embodiments, at 454, when forming the conductive planar slow-wave structure, in the form of a meander line structure, a first meander line element may be formed on a first portion of the support substrate, and a second meander line element may be formed on a second portion of the support substrate, wherein the first meander line element and the second meander line element may be arranged one over the other and spaced apart from each other. At 456, when forming the dielectric layer arrangement, a first dielectric layer may be formed in between the first meander line element and the first portion of the support substrate, the first dielectric layer being arranged on the first portion of the support substrate at only one or more support substrate portions overlapping with the first meander line element, and a second dielectric layer in between the second meander line element and the second portion of the support substrate, the second dielectric layer being arranged on the second portion of the support substrate at only one or more support substrate portions overlapping with the second meander line element.

In various embodiments, the planar slow wave structure may include an interdigitated structure. At 454, when forming the conductive planar slow-wave structure, in the form of an interdigitated structure, a plurality of first interdigital elements may be formed on a first portion of the support substrate, the plurality of first interdigital elements being coupled to each other, and a plurality of second interdigital elements may be formed on a second portion of the support substrate, the plurality of second interdigital elements being coupled to each other, wherein the plurality of first interdigital elements and the plurality of second interdigital elements may be arranged one over the other and interdigitated with each other. At 456, when forming the dielectric layer arrangement, a first dielectric layer may be formed in between the plurality of first interdigital elements and the first portion of the support substrate, the first dielectric layer being arranged on the first portion of the support substrate at only one or more support substrate portions overlapping with the plurality of first interdigital elements, and a second dielectric layer may be formed in between the plurality of second interdigital elements and the second portion of the support substrate, the second dielectric layer being arranged on the second portion of the support substrate at only one or more support substrate portions overlapping with the plurality of second interdigital elements.

Non-limiting examples of embodiments for addressing the challenges of dielectric charging will be described below with reference to FIGS. 5A to 5C in relation to a symmetric planar helix with straight edge connections (PH-SEC) which may be suitable for microfabrication.

FIG. 5A shows a schematic side view of a symmetric planar helix with straight edge connections (PH-SEC) 500, illustrating the cross-sectional side view of the structure. A cross-sectional view of the PH-SEC 500 may be as shown in FIG. 5B, for example, as seen in the direction F indicated in FIG. 5A.

The PH-SEC 500 may include a plurality of first elements (or upper conductor strips) 510*a* and a plurality of second elements (or lower conductor strips) 510*b* which may be connected by connectors (e.g., vertical connectors or conductors) 512, 514. The PH-SEC 500 may be similar to the PH-SEC in the context of FIGS. 3A and 3B.

The PH-SEC 500 may be arranged in between silicon oxide ($SiO_2$) layers (for example, a first $SiO_2$ layer 506*a* and a second $SiO_2$ layer 506*b*) and in between a first portion 502*a* of a silicon (Si) substrate and a second portion 502*b* of the Si substrate. The PH-SEC 500 is a symmetric planar helix structure as it is symmetrically placed between the first and second Si substrate portions 502*a*, 502*b*. In various embodiments, the first and second Si substrate portions 502*a*, 502*b* may be two separate silicon (Si) substrates or carriers. The entire structure of the PH-SEC 500 may be placed in a metal enclosure 550.

The conductive elements 510*a*, 510*b* and the connectors 512, 514 may define an electron beam tunnel 552. As shown in FIG. 5B, the electron beam tunnel 552 may have a height, 2a 522, and a width, 2b 524. The first and second elements (or conductor strips) 510*a*, 510*b* have a width, SW (306, FIG. 3A), a thickness, ST 530, and may terminate in ring pads 520 (see also ring pads 320, FIG. 3A) of diameter, RD. The connectors (e.g., or straight edge connections) 512, 514 have a diameter, VD 534, and may connect two ring pads 520 that face each other. The Si substrate portions 502*a*, 502*b* have a dielectric constant of 11.9 and a thickness, $h_2$ 536. There is a thin layer of $SiO_2$ 506*a*, 506*b* on each silicon substrate 502*a*, 502*b*, with a dielectric constant of 3.9 and a thickness $h_1$ 534. The metal enclosure 550 may have a height, 2c 526, and a width, 2d 528, such that the size of the metal enclosure 550 is 2c*2d. The period of the PH-SEC 500 is represented as L (304, FIG. 3A).

As shown in FIGS. 5A and 5B, the symmetric PH-SEC 500 has two silicon (Si) substrates or Si substrate portions 502*a*, 502*b*, each with a thin isolation layer of silicon dioxide ($SiO_2$) 506*a*, 506*b*. Since the $SiO_2$ layer 506*a*, 506*b* has poor electrical conductivity, the voltage between the conductive elements (or metal strips) 510*a*, 510*b* and the $SiO_2$ layer 506*a*, 506*b* may build up and cause dielectric charging problem.

An electron beam may propagate within the electron beam tunnel 552. Some of the electrons (represented by dashed lines 551) may pass directly through the electron beam tunnel 552. However, some electrons (represented by dashed lines 553) may be incident on the PH-SEC 500 and the $SiO_2$ layers 506*a*, 506*b*. $SiO_2$ is an insulating material with extremely low conductivity. As a result, the voltage between the metal strips 510*a*, 510*b* of the PH-SEC 500 and the $SiO_2$ layers 506*a*, 506*b* may easily build up and cause dielectric charging problems.

Various embodiments may include modifications to the symmetric PH-SEC 500 of FIGS. 5A and 5B to minimise or avoid dielectric charging problem. Various embodiments may be aimed at addressing or solving the problem of dielectric charging for structures such as the symmetric PH-SEC (e.g., 300, 301, 500) that are based on substrates including but not limited to silicon (Si). As shown in FIG. 5C, the approach in various embodiments may involve some modifications to the symmetric PH-SEC 500 of FIGS. 5A and 5B so as to provide a modified symmetric PH-SEC 500*a* of various embodiments. First, as will be described below, as the dielectric layer may dominate the dielectric charging effect, the $SiO_2$ layer may be etched off except under the conductive elements (or metal strips) 510*a*, 510*b* so as to form $SiO_2$ layers 506*c*, 506*d* on only the substrate portions 508*a*, 508*b* that overlap with the conductive elements 510*a*, 510*b*. This may generally prevent the electrons from hitting the $SiO_2$ layers 506*c*, 506*d*; instead, the electrons (represented by dashed lines 553) may land on the Si substrate portions 502*a*, 502*b* directly. Secondly, doped Si may be used instead of intrinsic Si for the Si substrate portions 502*a*, 502*b*. This increases the conductivity of Si, reducing in turn the relaxation time and increasing the speed of charge flow. Besides, the RF performance of the circuit is not affected by the etching of the $SiO_2$ layers 506*c*, 506*d* since the layers are very thin.

FIGS. 5A to 5C illustrate a non-limiting example of a practical configuration using dielectric substrates, where FIGS. 5A and 5B illustrate the unmodified symmetric PH-SEC while FIG. 5C illustrates the modified symmetric PH-SEC.

Modelling and simulations of dielectric charging models will now be described using the following non-limiting examples. First, a simple single-dielectric model may be used to study the dielectric charging phenomenon; the model may be analyzed using an equivalent circuit and simulated using Computer Simulation Technology (CST) Particle Studio. This may demonstrate that the phenomenon of dielectric charging may be simulated accurately. Then, a more realistic model including or consisting of two dielectric layers, e.g., Si and $SiO_2$, may be studied; this model may show that even a thin layer of $SiO_2$ may play a dominant role in dielectric charging.

Such studies may provide guidelines for modifications to the symmetric PH-SEC SWS to avoid the dielectric charging problem. As described above with reference to FIG. 5C, the $SiO_2$ layer may be removed between the conductive elements (or metal strips) to minimise or prevent the electrons from landing on the $SiO_2$ layer directly. Second, Si conductivity may be enhanced appropriately to avoid buildup of charge and voltage.

The properties of a dielectric material, namely, dielectric constant and conductivity, and the dimensions of the dielectric substrate may affect the dielectric charging. To understand the impact of these parameters, a simple single-dielectric model may be used. The behavior of the model may be analyzed using a simple equivalent circuit and is also simulated using a simulation tool CST (CST—Computer Simulation Technology) Particle Studio.

Figure 6A:
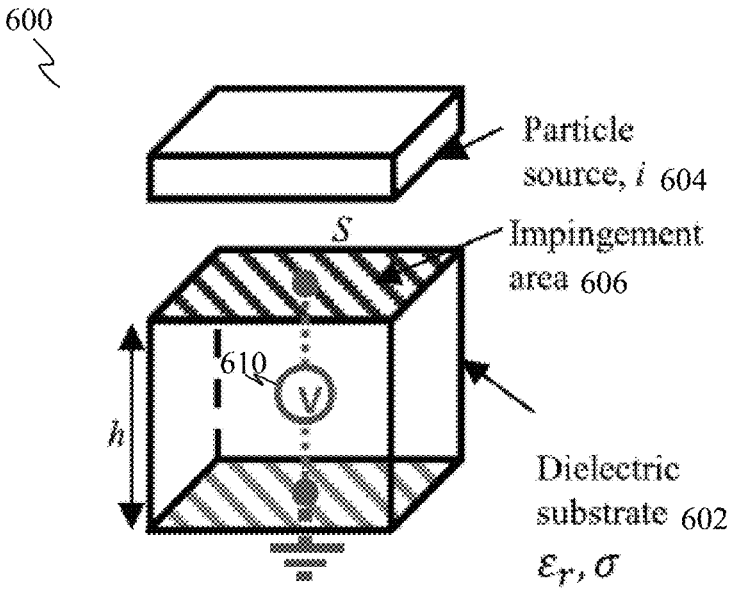
Figure 6B:
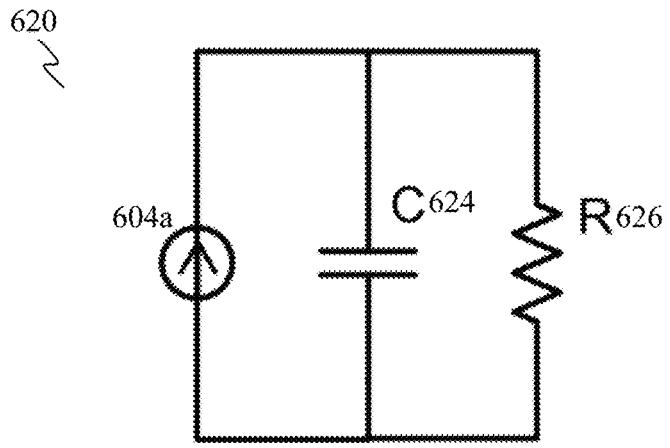
FIG. 6B shows an equivalent circuit of the model of FIG. 6A.

As shown in FIG. 6A, a model 600 having a dielectric substrate 602 with dielectric constant $\in_r$, conductivity σ, area of cross section S, and thickness h may be considered. The substrate 602 is grounded at the bottom and has a particle source 604 with current i placed above the substrate 602 with the same emission area as the cross-sectional area, S, of the substrate 602. The electron beam generated by the particle source 604 impinges on the top of the substrate 602 (e.g., at the impingement area 606), causing buildup of charge and voltage at the top surface of the substrate 602 (represented by the voltage symbol 610). At the same time, current flows from the top surface to the bottom surface of the substrate 602. The twin phenomena of charging and discharging may be represented by an equivalent circuit 620, as shown in FIG. 6B. In this circuit 620, the particle source 604 is represented as a constant current source 604*a*, which is connected to a parallel combination of a capacitor C 624 and a resistor R 626. The values of C and R may be calculated as follows:

$$C = \frac{\varepsilon_0 \varepsilon_r S}{h}(F), \qquad \text{(Equation 1)}$$

$$R = \frac{h}{\sigma S}(\Omega).,$$

where $\in_0$ refers to the permittivity of free space.

The voltage $V_c$ on the capacitor 624 is the solution to the simple differential equation $$C\frac{dV_c}{dt} = -\frac{V_c}{R} + i, \qquad \text{(Equation 2)}$$

$$V_c = Ri\left(1 - e^{-\frac{t}{T}}\right)(V). \qquad \text{(Equation 3)}$$

where t refers to time, and $T=RC=\in_0\in_r/\sigma$ is the relaxation time of the dielectric material.

From Equation 3, when t<<T, the following may be used $$V_c \approx Ri\left\{1 - \left[1 - \frac{t}{T} + \frac{1}{2}\left(\frac{t}{T}\right)^2 - \ldots\right]\right\} \qquad \text{(Equation 4)}$$

-continued $$\approx Ri\frac{t}{T}(V).$$

It may be observed that the voltage, $V_c$, linearly increases with time, t, for small values of t. Then, as the time t increases, the voltage, $V_c$, increases exponentially. Finally, when t>>T, the voltage, $V_c$, reaches the steady-state value of Ri. Thus, for a low-conductivity material, the relaxation time T and resistance R may be large and the steady-state voltage may build up to a high level. On the other hand, for a high-conductivity material, the steady-state voltage may be low and may be reached sooner.

The behaviour of the model described in the context of FIG. 6A may be examined through simulations by monitoring the time-varying voltage on the top surface of the substrate 602. Silicon (Si) may be chosen as the substrate material with a dielectric constant, $\in_r$, of about 11.9. The conductivity, σ, of Si may vary according to dopant concentration. Four different cases with different combinations of surface area, S, height, h, and σ, resulting in different values of the resistance, R, may be calculated and simulated for a particle current of about 0.02 A. The parameters for the four cases in the model are shown in Table I.

TABLE I

| Cases | 1 | 2 | 3 | 4 |
|---|---|---|---|---|
| h (mm) | 4 | 2 | 4 | 4 |
| S ($mm^2$) | 400 | 100 | 100 | 100 |
| σ (S/m) | 0.01 | 0.01 | 0.015 | 0.01 |
| $\varepsilon_r$ | 11.9 | 11.9 | 11.9 | 11.9 |

Figure 7:
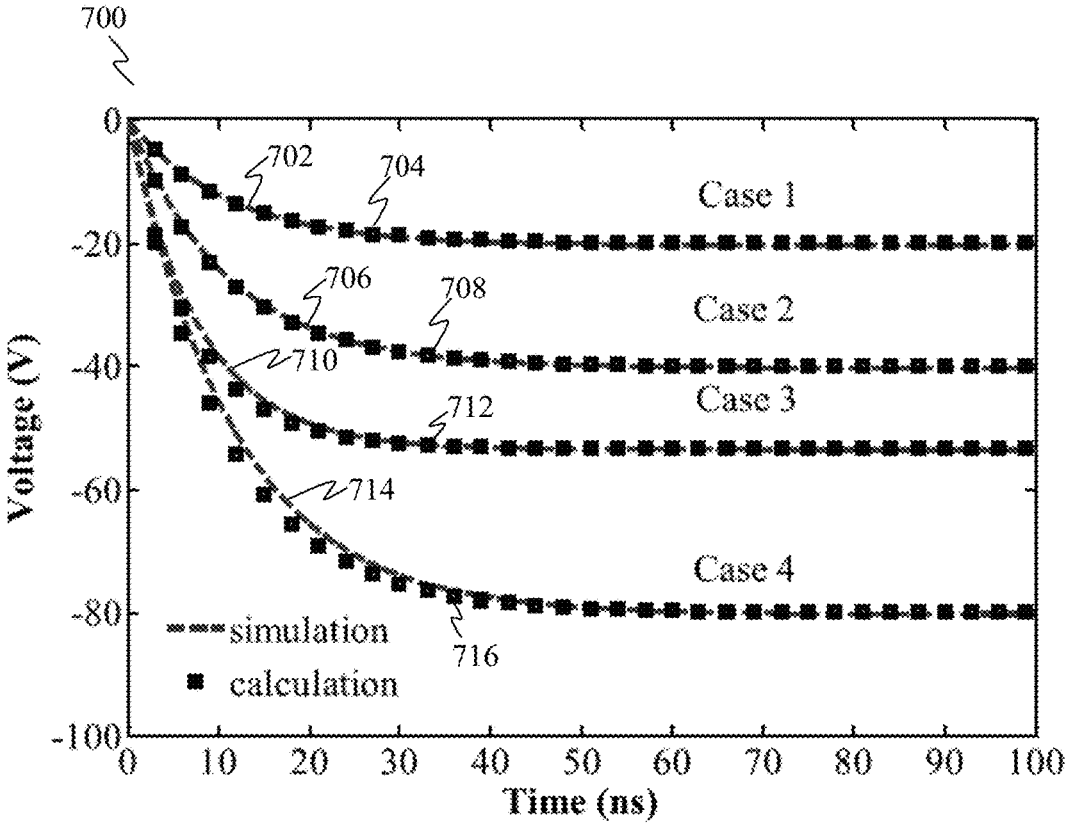
FIG. 7 shows a plot illustrating the relationship between the dielectric charging voltage versus time results using different combinations of surface area, height, and conductivity of a single-layer dielectric charging and discharging model, according to various embodiments.

A plot 700 illustrating the relationships between the dielectric charging voltage versus time for both calculations [based on Equation (3)] and simulations are shown in FIG. 7. The dashed-line curves represent the simulation results, and the square markers represent the calculation results. In Case 1, the simulation results are indicated by dotted line curve 702, while the calculation results are indicated by the square markers 704. In Case 2, the simulation results are indicated by dotted line curve 706, while the calculation results are indicated by the square markers 708. In Case 3, the simulation results are indicated by dotted line curve 710, while the calculation results are indicated by the square markers 712. In Case 4, the simulation results are indicated by dotted line curve 714, while the calculation results are indicated by the square markers 716. It may be observed from the plot 700 that the simulated results and the calculated results significantly match each other for each of the four cases. As the current provided is negative, the corresponding voltage is also negative. Since the steady-state voltage is proportional to the resistance R, this voltage is different for each of the four cases. From the results for Cases 3 and 4, which have the same dimensions but different conductivity values, it may be observed that the magnitude of the steady-state voltage is inversely proportional to the conductivity. Thus, with other parameters held constant, the conductivity of the material of the substrate may be used to restrict the buildup of voltage due to dielectric charging. In this context, it may be useful that the conductivity of Si may be varied precisely by controlling the dopant concentration.

In an actual (practical) TWT, the situation may be more complex than that represented by the above-mentioned model. For instance, the electrons may not hit the dielectric material at normal incidence. There may also be secondary emission from the dielectric material. The secondary electron yield (SEY) may depend on the material including the surface coatings, the beam energy, and the angle of incidence of the primary electrons. The SEY when the high-energy electrons of several kiloelectron volts impinge the Si layer may be firstly considered. The SEY of silicon (Si) is below 0.2 for electron energies in the range of 3-10 keV. Such a low value of SEY may not cause a significant change in the results. On the other hand, for Si or $SiO_2$-on-Si, SEY may be greater than one for low impact energies and may lead to changes in the extent and polarity of dielectric charging at some locations in a TWT. If the dielectric charge is allowed to accumulate, it may lead to multipacting as well. However, if the dielectric charge is dissipated through higher conductivity of the dielectric material, as in the various embodiments, such problems may not be likely to occur. Therefore, the effect of secondary electrons has not been considered. By doing so, more realistic and complex TWT structures may be examined through relatively simple simulations.

Instead of one layer that is considered in the previous model 600, the symmetric PH-SECs as illustrated in FIGS. 5A and 5C may have layers of dielectric materials, e.g., Si and $SiO_2$. These layers are not grounded on the opposite sides of the impingement area. Furthermore, the maximum voltage difference due to dielectric charging may be expected to develop between the metallic helix 500, 500*a* and locations midway between the helix turns. Therefore, next, another model that considers these differences may be studied.

Figure 8A:
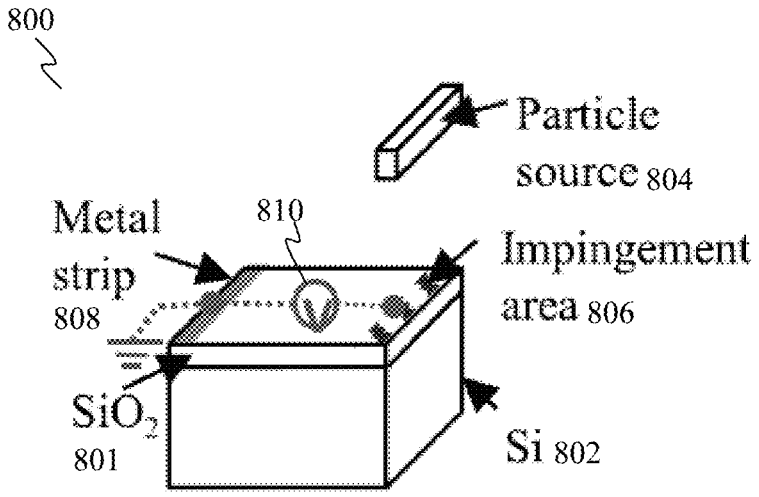
FIG. 8A shows a schematic view of a charging/discharging model with two layers of dielectrics.

In the two-layer model 800 shown in FIG. 8A, the upper layer 801 is $SiO_2$ and the lower layer 802 is Si. $SiO_2$ has a dielectric constant of 3.9 and a low conductivity of about 1e-14 S/m. The strip-shaped particle source 804 generates electrons that hit a narrow strip (e.g., at the impingement area 806) on the right edge of the top surface of the $SiO_2$ layer 801. There is a thin metal strip (e.g., representing a conductive element or conductor) 808 on the left side of this surface, which is connected to ground. When the electrons impinge on the $SiO_2$ layer 801, the charge and voltage build up, causing current flow (represented by the voltage symbol 810) to the grounded metal strip 808.

Figure 8B:
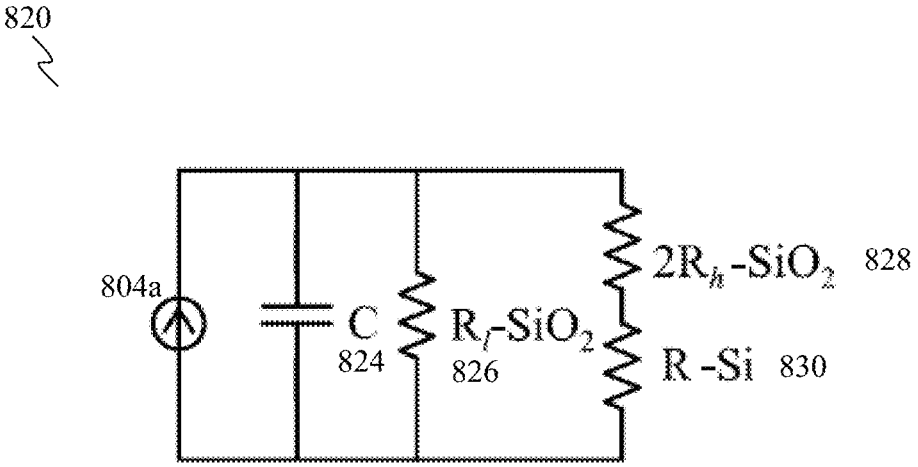

An equivalent circuit 820 for the two-layer model 800 may be as shown in FIG. 8B. In the circuit 820, the particle source 804 is represented as a constant current source 804*a*, which is connected to a parallel combination of a capacitor C 824, a resistor 826 equivalent to $R_l$—$SiO_2$, and a third parallel branch including or consisting of two series resistors 828, 830 respectively equivalent to $2R_h$—$SiO_2$ and R—Si.

Figure 8C:
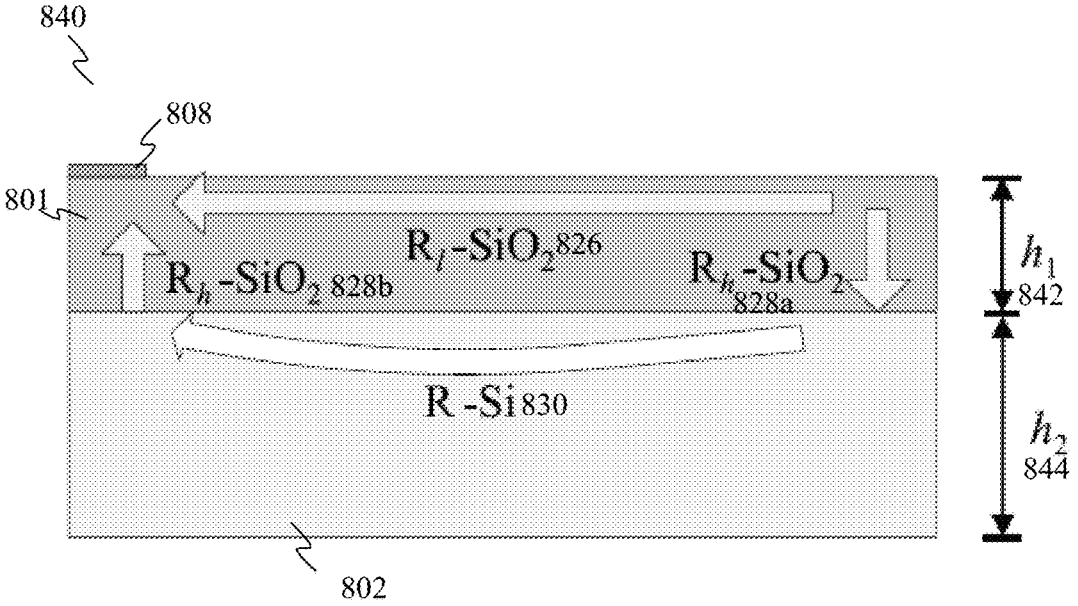
FIG. 8C shows a schematic view of the current paths in the two layers of dielectrics.

As shown in FIG. 8C, the current may flow either directly through the $SiO_2$ layer 801 or through a path involving both $SiO_2$ 801 and Si 802 layers. The current through the first path may encounter a resistance 826 that is labeled as $R_l$—$SiO_2$. The second path goes down through the $SiO_2$ layer 801, covers the length of the Si layer 802, and finally goes back to ground so that the corresponding resistances 828*a*, 830, 828*b* for this path are labeled as $2R_h$—$SiO_2$ and R—Si. Equations 3 and 4 still apply for the voltage $V_c$, but the expressions for the capacitor and resistor are complicated by the fact that the charge and current distribution may not be uniform. In general, assuming that the thickness, $h_1$ 842, of the $SiO_2$ layer 801 is quite small compared with the distance between the impingement area 806 and the grounded strip 808, the resistance for the second path is much smaller than that for the first path.

The two-layer model may be simulated using CST Particle Studio to study the effect of the thickness of the two layers and the conductivity of the Si layer 802. In one example, the surface area of the two layers is about 20×5.5 $mm^2$, the size of the particle source 804 is about 20×0.5 $mm^2$, and the current is about 1 mA. For a Si layer 802 having a thickness, $h_2$ 844, of about 4 mm and a conductivity of about 0.1 S/m, the effect of the thickness, $h_1$ 842, of the $SiO_2$ layer 808 is shown in plot 900 of FIG. 9A. Result 902 indicates the effects of $h_1$=0.1 mm. Result 904 indicates the effects of $h_1$=1 mm. Result 906 indicates the effects of $h_1$=2 mm, while Result 908 indicates the effects of $h_1$=4 mm. It may be observed from FIG. 9A that the voltage buildup between the impingement area 806 and the grounded strip 808 is relatively sensitive to $h_1$, in that, as the thickness $h_1$ decreases, the voltage also decreases. This may be because the resistor value $R_h$—$SiO_2$ 828*a*, 828*b* decreases as the thickness $h_1$ 842 of the $SiO_2$ layer 801 decreases. In these results, the simulation time belongs to the t<<T regime; the steady-state voltage (t>>T) for some of these cases may be of the order of 1000 V.

Figure 9A:
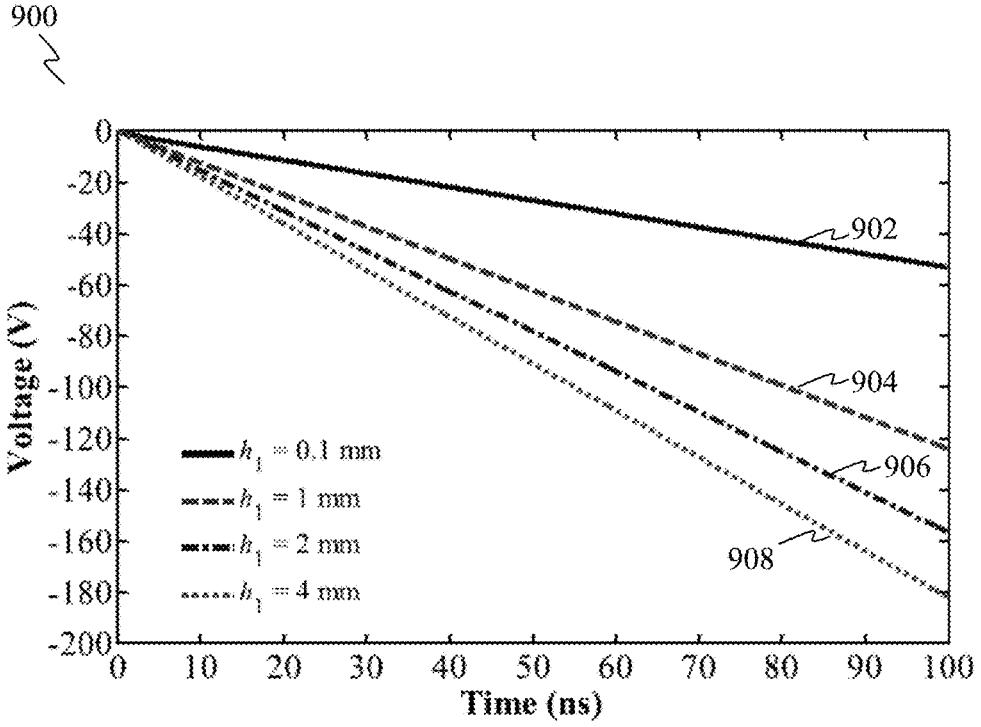
FIG. 9A shows a plot illustrating the dielectric charging voltage versus time for different thicknesses of a silicon oxide ($SiO_2$) layer, according to various embodiments.
Figure 9B:
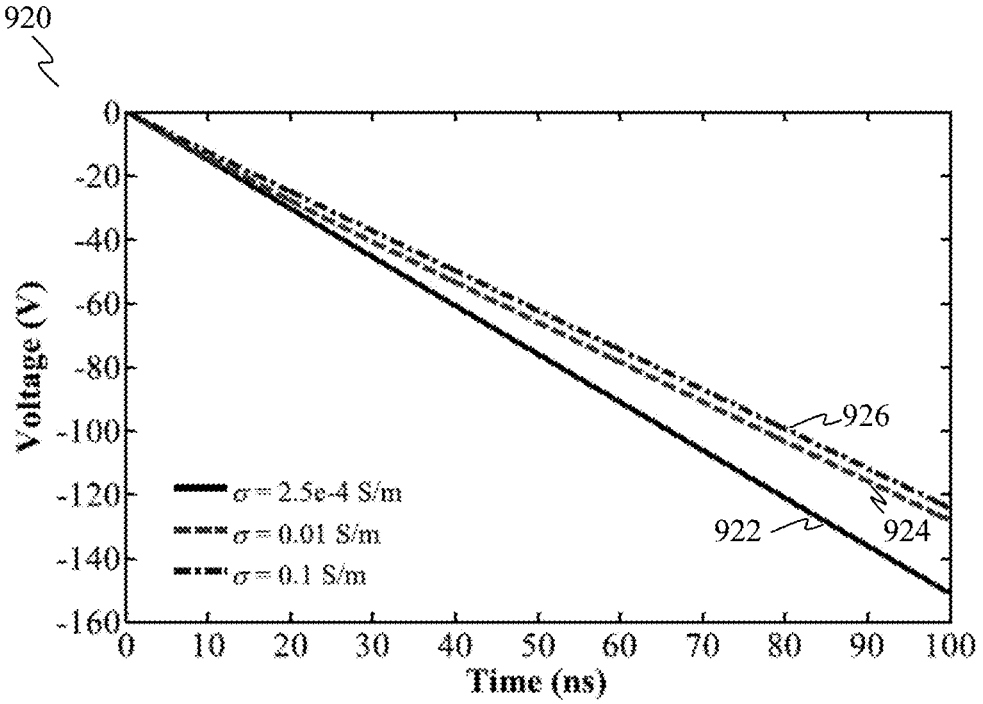
FIG. 9B shows a plot illustrating the voltage versus time for different conductivities of a silicon (Si) layer, according to various embodiments.

The voltage for different conductivity, σ, and thickness values of the Si layer 802 may also be studied, keeping the $SiO_2$ layer 801 thickness, $h_1$ 842, at about 1 mm, where the results may be as observed in plot 920 of FIG. 9B. Result 922 indicates the voltage versus time relationship for σ=2.5e-4 S/m, while result 924 indicates the voltage versus time relationship for σ=0.01 S/m, and result 926 indicates the voltage versus time relationship for σ=0.1 S/m. It may be observed from FIG. 9B that the voltage decreases as the conductivity σ increases. This may be caused by a decrease in the value of the resistor R—Si 830.

Figure 9C:
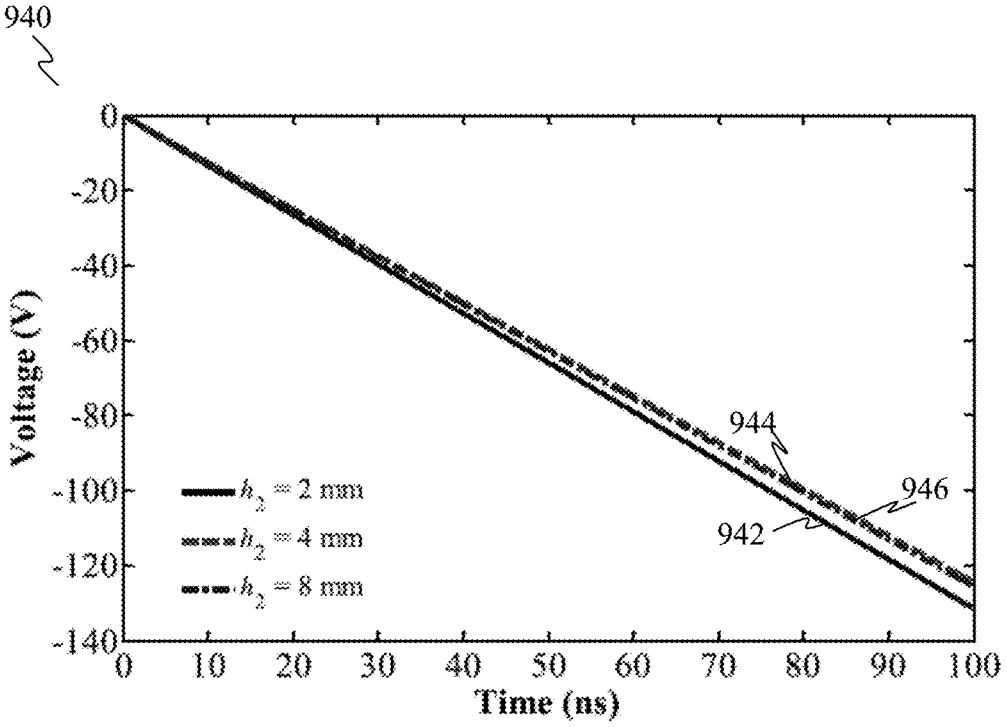
FIG. 9C shows a plot illustrating the voltage versus time for different thicknesses of a silicon (Si) layer, according to various embodiments.

FIG. 9C shows a plot 940 illustrating the voltage versus time with different thicknesses, $h_2$ 844, of the Si layer 802, according to various embodiments. Plot 940 shows that the value of the voltage may not be sensitive to the thickness of the Si layer 810. Result 942 indicates the voltage versus time relationship for $h_2$=2 mm, while result 944 indicates the voltage versus time relationship for $h_2$=4 mm, and result 946 indicates the voltage versus time relationship for $h_2$=8 mm.

FIGS. 9A to 9C show that the $SiO_2$ layer 801 dominates the dielectric charging effect in the two-layer model 800. This may be caused by a large relaxation time T associated with the high resistivity of $SiO_2$ 801. Thus, it may be concluded that the dielectric charging in such a two-layer structure may be reduced by removing the $SiO_2$ layer 801 where possible and by increasing the conductivity of the Si layer 802 while noting the RF insertion loss. While the above-mentioned results have been obtained using a simple model with dimensions of the order of millimeters for easier simulations, it may be expected that the conclusion holds good for more realistic structures with dimensions scaled down to micrometers.

The performance of the various embodiments and the effects of the modifications as described above will now be presented by way of the following non-limiting examples. It may be shown that the modified SWS exhibits substantially reduced dielectric charging while maintaining a low insertion loss.

Figure 10:
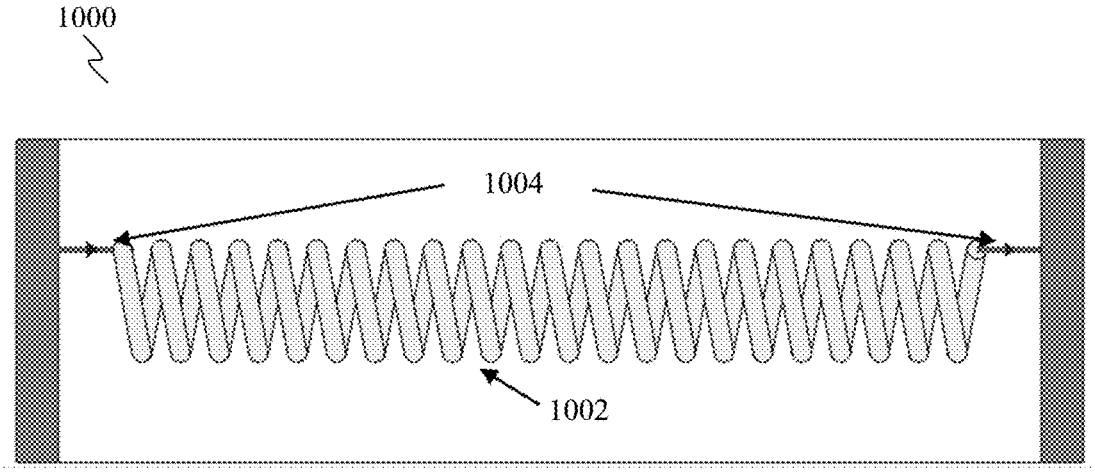
FIG. 10 shows a schematic top view of a helix structure, according to various embodiments.

FIG. 10 shows a schematic top view 1000 of a helix structure (or helical structure) 1002, in accordance with various embodiments. The top substrate (e.g., 508*a* FIG. 5C) is not shown in order to have a clear view of the structure 1002. The dimensional parameters are as shown in FIG. 5B and the numerical values are presented in Table II.

TABLE II (Dimensions of the modified symmetric PH-SEC)

| Symbol (numeral reference in FIG. 3A or FIG. 5B) | Dimensions in μm |
|---|---|
| 2a (522) | 300 |
| 2b (524) | 700 |
| 2c (526) | 500 |
| 2d (528) | 2500 |
| L (304) | 300 |
| ST (530) | 20 |
| SW (306) | 150 |
| VD (532) | 100 |
| RD (308) | 150 |
| $h_1$ (534) | 3 |
| $h_2$ (536) | 20 |

The structure 1002 incorporating 22 periods may be simulated using a 3-dimensional electromagnetic simulator, Computer Simulation Technology Microwave Studio (CST MWS) transient solver (CST—Computer Simulation Technology). Discrete ports 1004 of about 60 Ohm may be used at the input (e.g., the RF input 126, FIG. 1) and the output (e.g., the RF output 128, FIG. 1). Conductivity of Si may be chosen as about 0.1 S/m.

Figure 11:
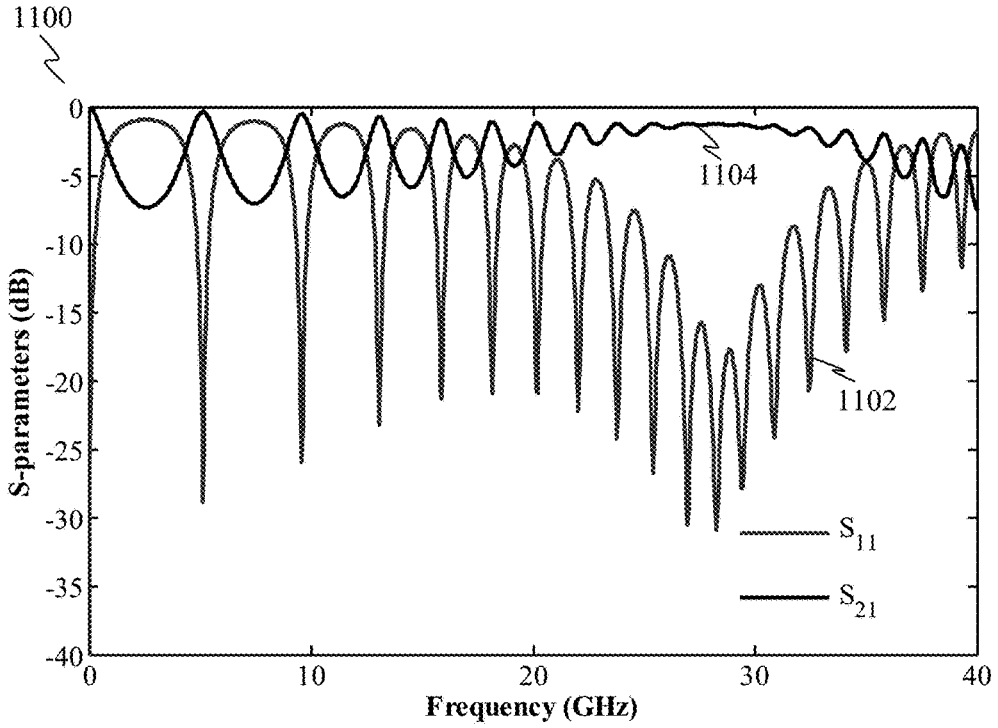
FIG. 11 shows a plot illustrating the S-parameters, according to various embodiments.

Plot 1100 illustrating the simulated S parameters are shown in FIG. 11. In FIG. 11, result 1102 represents the relationship between the S-parameter $S_{11}$ and frequency, while result 1104 represents the relationship between S-parameter $S_{21}$ and frequency. As may be observed from result 1102, $S_{11}$ is below −15 dB from about 26.6-30 GHz. The loss ($S_{21}$ 1104) at about 28 GHz is about −1.3 dB.

The additional loss (e.g., loss per period) caused by the higher conductivity of Si may be estimated using the CST MWS transient solver. The loss per period for the structure of various embodiments with four different conductivity values may be calculated from the difference in $S_{21}$ and the number of periods. The results at about 28.3 GHz are shown in Table III.

TABLE III (Loss per period at 28.3 GHz for different conductivities)

| Conductivity (S/m) | 2.5e−4 | 0.01 | 0.1 | 0.25 |
|---|---|---|---|---|
| Loss (dB/period) | 0.034 | 0.036 | 0.060 | 0.100 |

It may be observed that even when the conductivity goes up to about 0.1 S/m, the loss may be only about 0.06 dB/period which may be still considered acceptable in a TWT (for example, at Ka-band).

Particle-in-cell (PIC) simulations for a TWT including or consisting of 136 periods of the modified SWS show that increasing the conductivity of silicon to about 0.1 S/m may reduce the TWT gain by about 2 dB compared with that for intrinsic silicon. Furthermore, simulations using CST eigenmode solver (CST—Computer Simulation Technology, US) show that the increased loss due to increase in conductivity of Si may not show significant effect on the phase velocity and interaction impedance values. The modifications in accordance with various embodiments to avoid dielectric charging may be compatible with microfabrication and may also be applicable to other microfabricated SWSs, for applications in TWTs, such as meander-line and biplanar interdigital structure.

Examples of dielectric charging in the symmetric planar helix with straight edge connections (PH-SEC) will be described as follows, with reference to FIGS. 3A, 5A and 5B. The dielectric charging effect is studied for the symmetric PH-SEC SWS (e.g., FIGS. 5A and 5B) for application in a TWT. Most of the dimensional parameters are shown in FIG. 5B. The height and width of the electron beam tunnel are 2a 522 and 2b 524, respectively, and the period of the SWS 300 (FIG. 3A) is L 304 (FIG. 3A). The conductor strips 302 (FIG. 3A) have width SW 306 (FIG. 3A) and thickness ST 530, and terminate in ring pads 320 (FIG. 3A) of diameter RD 308 (FIG. 3A). The straight-edge connections 512, 514 of diameter VD 532 connect two ring pads 320 (FIG. 3A) that face each other. The thickness of the Si layer 504 is $h_2$ 536. There is a thin layer of $SiO_2$ 506 with a thickness $h_1$ 534 on each silicon substrate 504. The size of the metal enclosure 550 is 2c 526 by 2d 528. The values of all the parameters used in the simulations are listed in Table II.

To avoid the dielectric charging problem, two modifications may be applied to the SWS. First, since the $SiO_2$ layer (e.g., the $SiO_2$ layer 506*a*, 506*b*, FIG. 5B) has been found to dominate the dielectric charging effect as previously discussed above, the $SiO_2$ layers 506*a*, 506*b* may be removed except beneath the metal strips 510*a*, 510*b* (see FIG. 5C). This prevents the electrons from hitting the $SiO_2$ layers 506*c*, 506*d* directly. Besides, the RF performance of the circuit may not be affected since the $SiO_2$ layers 506*c*, 506*d* are comparatively thin. Second, doped Si 502*a*, 502*b* (FIG. 5C) with appropriate conductivity may be used instead of intrinsic Si. These modifications may be expected to reduce the relaxation time of the two-layer structure and restrict the voltage buildup due to dielectric charging. A schematic cross-sectional side view of the resulting modified symmetric PH-SEC of various embodiments is shown in FIG. 5C.

Simulations may be carried out for the symmetric PH-SEC, both with and without the above-mentioned modifications. It may be assumed that the dc voltage of the SWS is maintained at 0 V. Therefore, when the electrons hit the metallic SWS (having the metal strips 510*a*, 510*b* and the straight-edge connections 512, 514), the charge may be conducted away. On the other hand, when the electrons hit the dielectric substrate (e.g., $SiO_2$ layer), the charge may accumulate if the substrate has a poor conductivity.

Figure 12A:
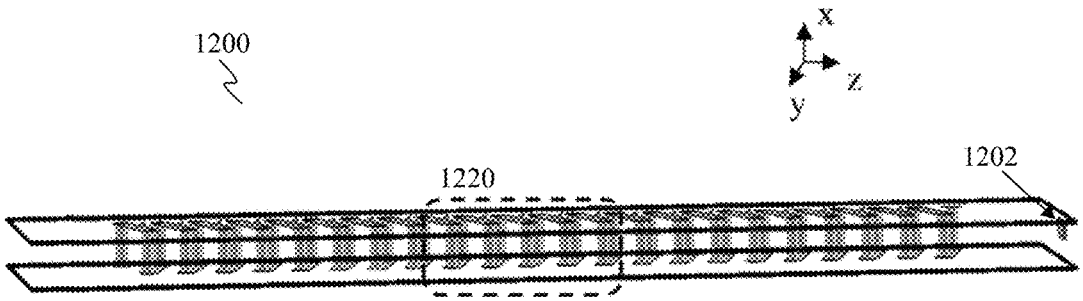
FIG. 12A shows a perspective view of a simulation model for a symmetric planar helix with straight edge connections (PH-SECs), according to various embodiments.
Figure 12B:
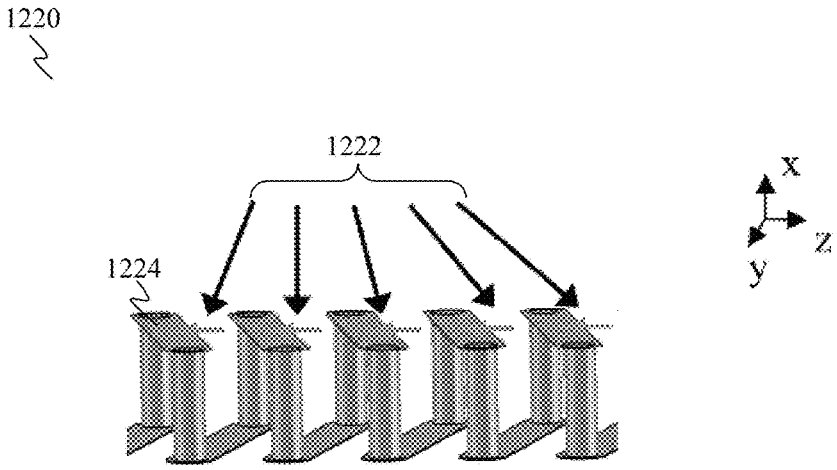
FIG. 12B shows an enlarged view of a part of FIG. 12A.

FIG. 12A shows a perspective view of a simulation model for the symmetric PH-SEC 1200. FIG. 12B shows an enlarged view of an area indicated by the dashed-line rectangle 1220. As shown in FIGS. 12A and 12B, 22 periods of the symmetric PH-SEC 1200 are simulated, placing 21 voltage monitors 1222 (FIG. 12B) that measure the voltage between each metal strip 1224 and the nearest center point between two metal strips 1224. Voltage monitor 1 is closest to a particle source 1202, and voltage monitor 21 is farthest. The size of the particle source 1202 is about 350 μm×150 μm, and it generates a sheet (electron) beam. The voltage and current of the particle source 1202 may be set to about 3700 V and about 0.15 A, respectively. To incorporate to a certain extent the effects of misalignment between the electron gun and the SWS, and the angular spread of the electron beam, it may be assumed that the particle source 1202 has an inclination of about 2° with respect to the x-axis and emits a beam with an angular spread of about 2°. In other words, an angular beam spread of about 2 degrees may be used, and the particle source 1202 may be assumed to have an inclination of about 2 degrees with respect to the xy-plane. The Brillouin magnetic field for a circular beam with the same charge density is about 0.32 T. This value may be used as a reference and a focusing magnetic field at about 0.3 T may be set. In the simulations, the number of mesh cells may be 2.3 million for 22 periods. The number of emission points may be 18. It may take about 28 h for one simulation for 10 ns of TWT operation with Graphics Processing Unit acceleration.

Particle-in-cell (PIC) simulations may be carried out for both the symmetric PH-SEC and the modified symmetric PH-SEC.

Figure 13A:
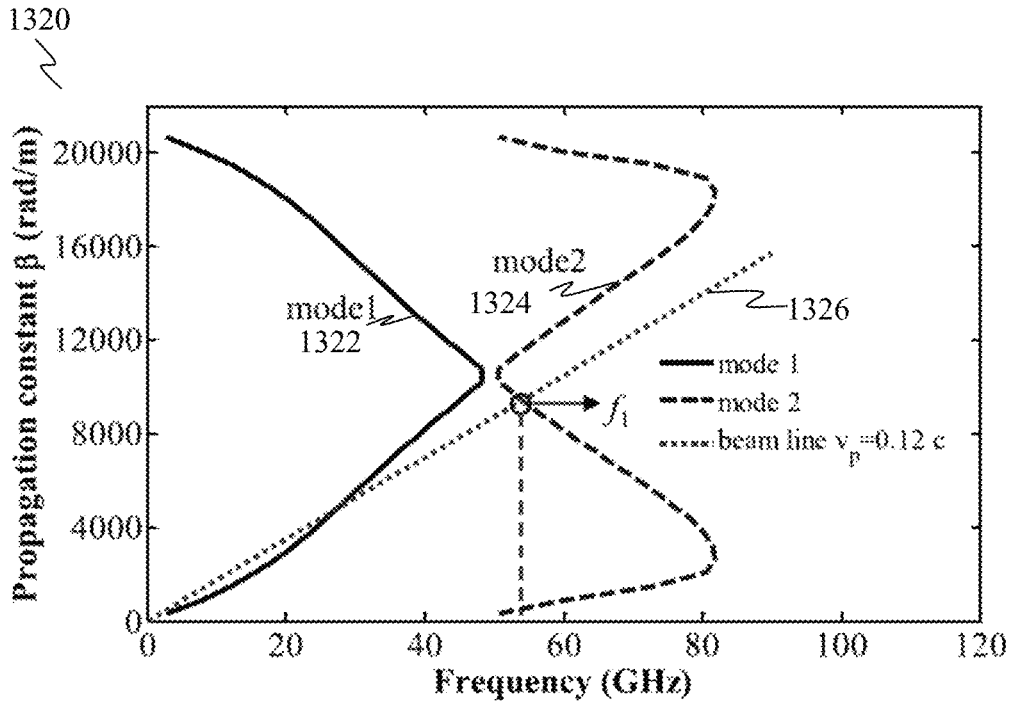
FIG. 13A shows a plot illustrating a dispersion diagram of an unmodified symmetric PH-SEC, according to various embodiments.

The Particle-in-Cell (PIC) simulations may be carried out without any RF input. Yet, the voltage obtained from the voltage monitors may be found to display high-frequency oscillations (results not shown here). To explain these oscillations, plot 1320 of FIG. 13A may be referred to, showing an example of the dispersion characteristics of the symmetric PH-SEC (without modifications) together with the beam line. In FIG. 13A, result 1322 represents the propagation constant versus frequency relationship for mode 1, while result 1324 represents the propagation constant versus frequency relationship for mode 2. A beam line 1326 of $v_p$=0.12 c (where $v_p$ is phase velocity and c is the speed of light) intersects with mode 2 (1324) in the backward wave region at about 54 GHz ($f_1$). The concept of modes is covered in most text-books on electromagnetics and is well understood by people working in this technical area. For example, see 'Advanced Engineering Electromagnetics' by C. A. Balanis, John Wiley & Sons, 2nd Edition, 2012 (see page 123). Accordingly, descriptions relating to the terms "mode 1" and "mode 2" mentioned above are omitted herein.

Figure 13B:
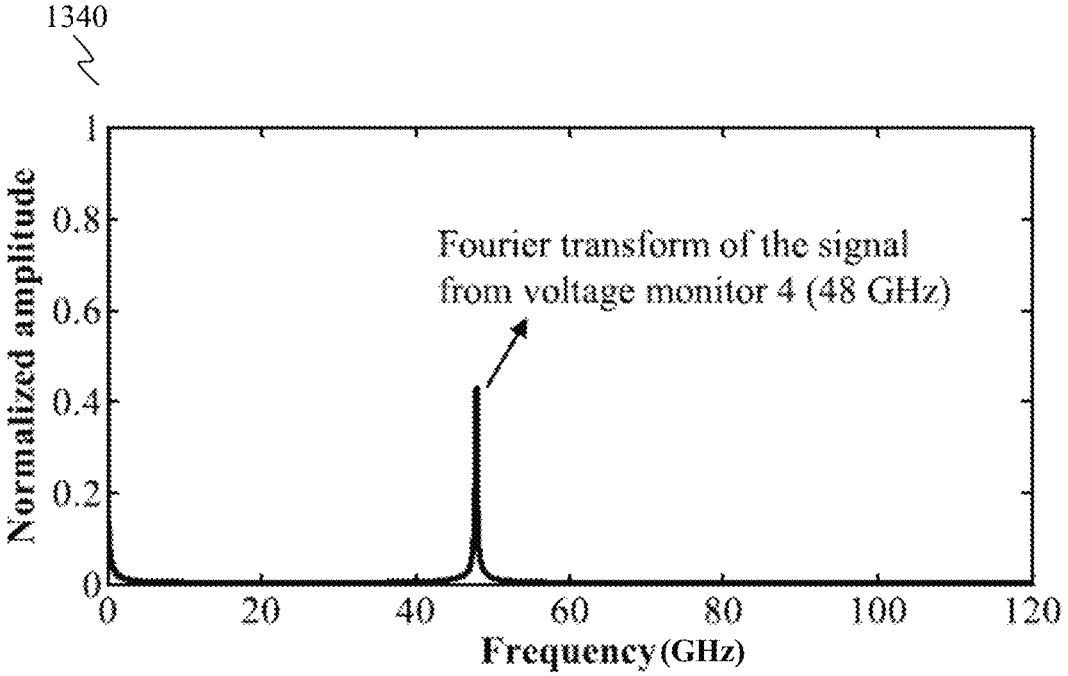
FIG. 13B shows a plot illustrating a spectrum of the dielectric charging voltage captured from voltage monitor 4, according to various embodiments.

Fourier transform of the signal from voltage monitor 4, shown in plot 1340 of FIG. 13B, shows a peak at about 48 GHz. This frequency may be considered close to the backward-wave oscillation frequency indicated by the dispersion diagram.

Figure 13C:
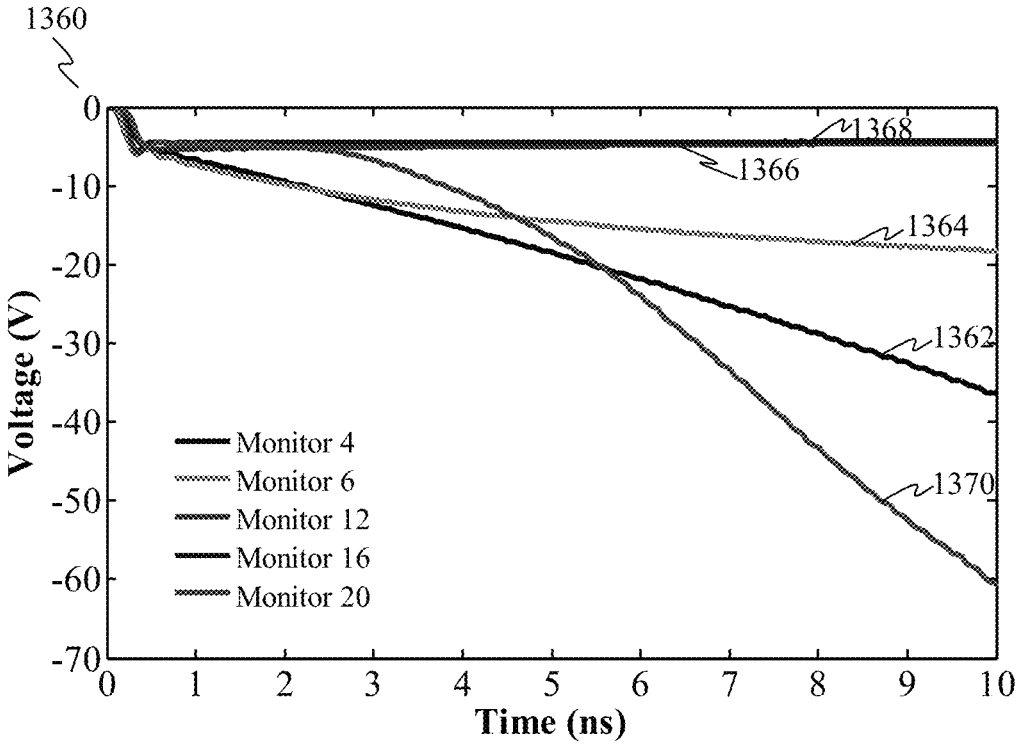
FIG. 13C shows a plot illustrating the dielectric charging voltage obtained from different voltage monitors for an unmodified structure, according to various embodiments.

Since the focus in this context is on dielectric charging, the dc voltage values may (only) be compared, by filtering out the high-frequency components. The voltages corresponding to some of the voltage monitors for the unmodified structure are shown in plot 1360 of FIG. 13C. In FIG. 13C, result 1362 represents the voltage versus time relationship for voltage monitor 4, result 1364 represents the voltage versus time relationship for voltage monitor 6, result 1366 represents the voltage versus time relationship for voltage monitor 12, result 1368 represents the voltage versus time relationship for voltage monitor 16, and result 1370 represents the voltage versus time relationship for voltage monitor 20. It may be observed that at some of the locations, where more electrons hit the dielectric substrate, the magnitude of the voltage keeps increasing for the simulation time considered in this example as seen from the cases for the voltages from voltage monitors 4, 6, and 20. As mentioned earlier, the steady-state voltage values may reach 1000 V and, therefore, may approach the dielectric breakdown (the dielectric strength of Si is about 4-10 V/μm). In any case, such high voltages may cause defocusing of the electron beam. On the other hand, at some other locations where fewer electrons hit the dielectric substrate, the voltage is low, for example, for voltage monitors 12 and 16.

Figure 13D:
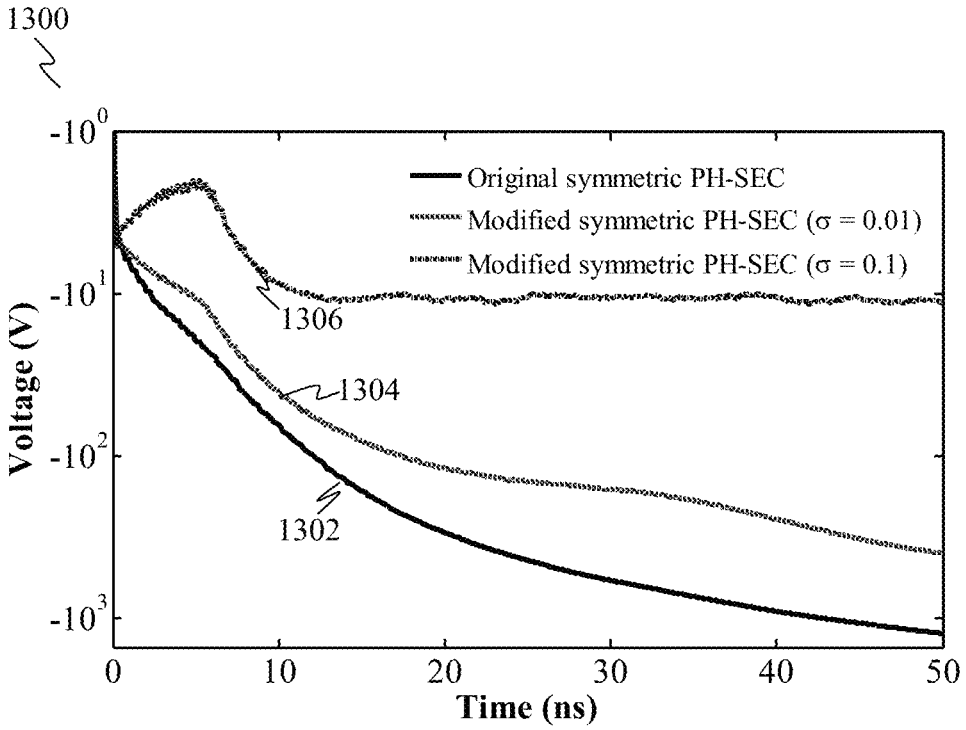
FIG. 13D shows a plot illustrating the relationship of voltage versus time for an original (unmodified) symmetric PH-SEC and modified symmetric PH-SECs with different silicon (Si) conductivities, according to various embodiments.

Voltages may be captured using simulation. In order to better compare the two structures, (only) the voltage with the highest value among all voltage monitors may be compared. In this example, the highest value of voltage may be captured by the fourth voltage monitor from the right (see, for example, FIG. 12A). The voltages for the original (unmodified) symmetric PH-SEC and the modified symmetric PH-SEC with different Si conductivities, σ, are presented in plot 1300 of FIG. 13D. In FIG. 13D, result 1302 represents the voltage versus time relationship for the original (unmodified) symmetric PH-SEC, while result 1304 represents the voltage versus time relationship for the modified symmetric PH-SEC with σ=0.01 S/m, and result 1306 represents the voltage versus time relationship for the modified symmetric PH-SEC with σ=0.1 S/m. It may be observed that the voltage magnitude due to dielectric charging in the original (unmodified) symmetric PH-SEC (result 1302) increases rapidly with time and exceeds 1000 V. This voltage may not only cause dielectric breakdown of Si (dielectric strength of Si is about 4-10 V/μm), but may also cause de-focusing of the electron beam. On the other hand, the modified structure (results 1304, 1306) has a lower voltage and the magnitude of the voltage decreases as the conductivity increases. When the conductivity of Si is about 0.1 S/m, the voltage magnitude may (only) reach about 10 V, which is a reduction by about 2 orders of magnitude. These results show that the symmetric PH-SEC, as modified in various embodiments, has a lower dielectric charging effect than the structure without these modifications (i.e., original (unmodified) symmetric PH-SEC), The results also show that the modified symmetric PH-SEC with increased Si conductivity may minimise or avoid the dielectric charging problem.

It should be appreciated that the above non-limiting examples, based on the symmetric PH-SEC, are exemplary embodiments. There may be other planar slow-wave structures (SWSs) which may be microfabricated and may have applications similar to those of the symmetric PH-SEC. These structures may include, for example, the biplanar interdigital slow wave structure which uses selectively metalized diamond substrates, SWSs derived from meander-line structure, and SWSs derived from the PH-SEC. These other planar SWSs may also benefit from the modified structure in accordance with various embodiments to avoid or at least reduce the problem of dielectric charging.

Further, there may be devices other than TWTs which use dielectric-loaded waveguide structures, such as gyro-TWT and slow-wave cyclotron amplifier. These structures may also be susceptible to the problem of dielectric charging and may benefit from the modified structure in accordance with various embodiments.

In a similar manner, the embodiments described above using Si and $SiO_2$ are only exemplary and materials not limited to Si or $SiO_2$ may be used. For example, instead of Si, substrate materials such as Ge, GaAs or InP whose conductivity may be modified by using suitable dopants may be used. Instead of $SiO_2$, other insulating materials such as berylllia or diamond may be used.

Moreover, the frequency range of about 26.6-30 GHz and the corresponding dimensions shown in Table II are also exemplary. It should be understood and appreciated that various dimensions may generally scale with wavelength. Therefore, as the wavelength of operation increases or decreases, the dimensions also increase or decrease, respectively.

Various embodiments may include a planar helix with straight-edge connections (PH-SECs), with modifications, which may avoid dielectric charging problem when it is used, for example, in a travelling-wave tube (TWT). The planar helix SWS may be suitable for microfabrication using materials such as silicon (Si) and silicon dioxide ($SiO_2$). The dielectric charging effect in PH-SECs, which are fabricated using Si and $SiO_2$ layers, have been discussed above. A simple dielectric slab model has been used to study the effect of conductivity and dimensional parameters of a dielectric substrate on dielectric charging. A corresponding equivalent circuit has been proposed and analyzed. The analysis results show an excellent match with the simulation results obtained from Computer Simulation Technology (CST) Particle Studio.

A more realistic double-dielectric model has been considered to obtain guidelines to avoid dielectric charging. Based on these guidelines, two simple modifications may be suggested for the planar helix SWS when it is microfabricated, for example, using Si wafers and a layer of $SiO_2$. This model with two dielectric layers, Si and $SiO_2$, has also been discussed above. The simulation results show that while the $SiO_2$ layer may play a dominant role in the dielectric charging process, Si conductivity may also play a role in this process. The simulation results are presented for a Ka-band planar helix SWS to demonstrate a significant reduction in dielectric charging while maintaining a low insertion loss when these modifications are incorporated. In other words, based on these observations, modifications to a Ka-band symmetric PH-SEC SWS may be provided to prevent dielectric charging in a TWT. These modifications reduce the voltage buildup due to dielectric charging. The modifications may involve partial removal of the $SiO_2$ layer and a careful increase/enhancement in the conductivity of the Si layer. The additional loss caused by the increased conductivity of Si may also be acceptable in a TWT. The techniques or modifications in accordance with various embodiments may be compatible with microfabrication and may also be applicable to other microfabricated SWSs. For example, such modifications may be expected to be useful in microfabricated millimeter-wave TWTs.

The methods suggested in the literature so far to prevent dielectric charging problem are mostly applicable to the circular helix. The embodiments disclosed herein may solve the dielectric charging problem in vacuum electron devices that are based on different types of waveguide structures. For example, the insulating layer such as $SiO_2$ may be etched off periodically to prevent the electrons from hitting the insulating material directly.

Figure 14:
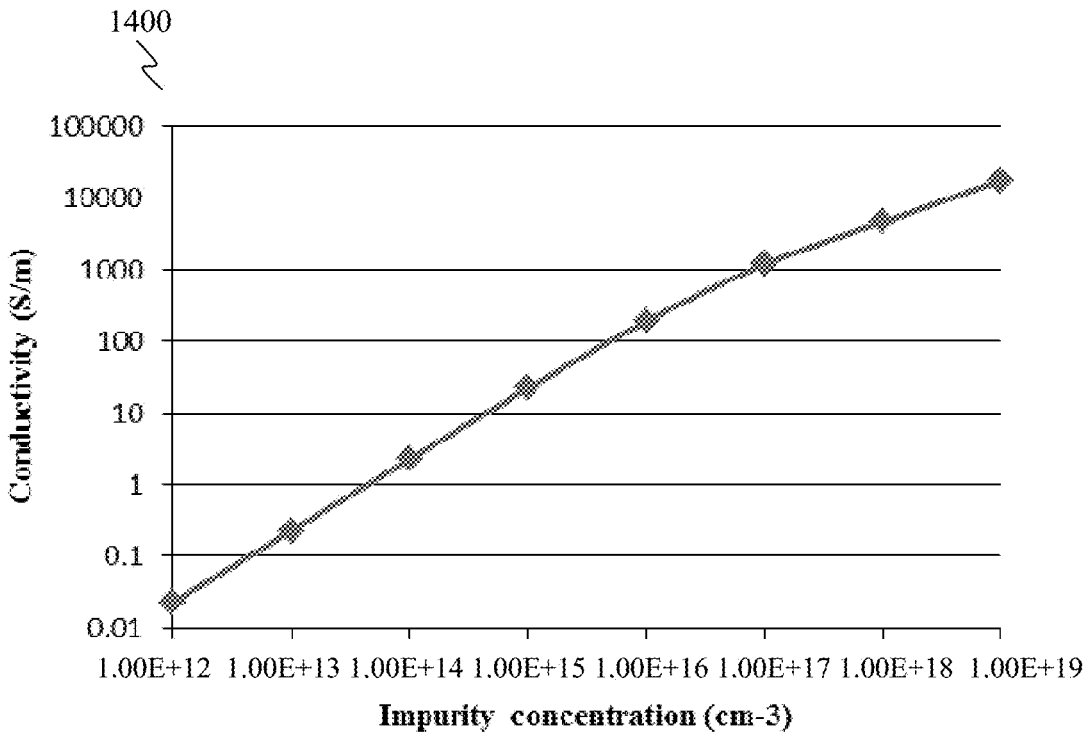
FIG. 14 shows a plot illustrating the Si conductivities for different concentrations of arsenic, according to one embodiment.

Low-resistivity substrates such as silicon may be used to conduct the charge away and restrict the dielectric charging voltage to an insignificant value. The conductivity of various substrate materials may be controlled easily by varying the concentration of the dopant used. A suitable range of values of conductivity may be selected to minimize dielectric charging without causing excessive RF loss. As an example, arsenic (As), boron (B) or phosphorous (P) may be used as dopants for silicon (Si); the variation of conductivity with doping concentration may follow the relation of: $\sigma=q(n\mu_n+p\mu_p)$ where $\sigma$ is the conductivity, q is the electron charge, n and p are the concentrations of electrons and holes respectively, and $\mu_n$ and $\mu_p$ are the mobilities of electrons and holes, respectively. The variation of conductivity of Si with concentration of arsenic as dopant is shown in plot 1400 of FIG. 14.

As described above, the modifications described herein may be compatible with microfabrication, where various embodiments may provide a solution to dielectric charging problem in microfabricated structures.

The structures in accordance with various embodiments, as described herein, have several advantages and improvements over existing methods, devices or materials. For example, the approach in accordance with various embodiments may be applicable to planar slow-wave structures including but not limited to the planar helix, meander-line, biplanar interdigital structure, or their derivatives. These structures may be amenable to fabrication using microfabrication techniques. This may be important since microfabrication may be generally required or mandatory for high frequency applications. Furthermore, in many of these structures, a sheet electron beam may be incorporated instead of a round electron beam. A sheet beam may offer the advantages of higher current capacity, decreased beam voltage and increased bandwidth.

The approach in accordance with various embodiments may also be applicable to vacuum electronics devices including but not limited to TWTs that use dielectric loaded waveguide structures and therefore are susceptible to the problem of dielectric charging. To solve the dielectric charging problem, in conventional devices, the focusing magnetic field may be adjusted so that fewer electrons hit the substrate. However, doing so is a remedial process which may be time-consuming and very inefficient. On the other hand, the approach in accordance with various embodiments may be readily incorporated in the design and fabrication of the waveguide structures without requiring additional cost and effort.

Further, in conventional devices, the dielectric stubs may be coated with conductive materials such as graphene. However, the thickness of the coating may be difficult to control and a small increase in the thickness may cause excessive loss in the circuit. In contrast, the structures in accordance with various embodiments do not require carefully controlled thickness of certain materials and may be based on bulk substrate with a suitable value of conductivity.

Commercial applications of the structures/devices in accordance with various embodiments may include a solution to dielectric charging problem that is aimed at applications in millimeter wave or terahertz vacuum electronics devices including but not limited to travelling wave tube (TWT) amplifiers or oscillators. As an amplifier, these devices may serve as the final stage amplifier in millimeter-wave communication transmitters due to their high output power, compact size and long lifetime. These devices may also be the superior technology choice for microwave power transmitters in electronic countermeasure (EMC) systems. As an oscillator (e.g., BWO), these devices may be applied to millimeter or terahertz high resolution imaging, for example, security screening, hazardous chemicals detection and cancer detection. The structures or devices in accordance with various embodiments, suitable for waveguide structures with planar geometry, may be compatible with microelectromechanical systems (MEMS) microfabrication techniques which may result in significant cost reduction. Prevention of dielectric charging at no additional cost may make the structures or devices in accordance with various embodiments promising for application in high frequency vacuum electronics devices.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalence of the claims are therefore intended to be embraced.

The invention claimed is:

1. An electron device comprising:

a support substrate;

a conductive planar slow-wave structure on the support substrate, the conductive planar slow-wave structure being adapted to receive an electromagnetic wave signal for interaction with an electron beam; and a dielectric layer arrangement in between the conductive planar slow-wave structure and the support substrate, the dielectric layer arrangement being arranged on the support substrate only on one or more portions of the support substrate which are overlapped by the conductive planar slow-wave structure.

2. The electron device as claimed in claim 1, wherein the dielectric layer arrangement contacts the conductive planar slow-wave structure.

3. The electron device as claimed in claim 2, wherein the dielectric layer arrangement contacts only a surface of the conductive planar slow-wave structure facing the support substrate.

4. The electron device as claimed in claim 1, wherein the support substrate comprises dopants.

5. The electron device as claimed in claim 1, wherein the conductive planar slow wave structure comprises a planar helix structure, the planar helix structure comprising:

a plurality of first elements on a first portion of the support substrate;

a plurality of second elements on a second portion of the support substrate, wherein the plurality of first elements and the plurality of second elements are arranged one over the other; and a plurality of connectors, each respective connector of the plurality of connectors is arranged to connect an end region of an associated first element of the plurality of first elements to an end region of an associated second element of the plurality of second elements, and wherein the dielectric layer arrangement comprises:

a first dielectric layer in between the plurality of first elements and the first portion of the support substrate, the first dielectric layer being arranged on the first portion of the support substrate at only one or more support substrate portions overlapping with the plurality of first elements, and a second dielectric layer in between the plurality of second elements and the second portion of the support substrate, the second dielectric layer being arranged on the second portion of the support substrate at only one or more support substrate portions overlapping with the plurality of second elements.

6. The electron device as claimed in claim 5, wherein the plurality of first elements and the plurality of second elements are inclined at symmetric angles of opposite signs.

7. The electron device as claimed in claim 5, wherein the plurality of connectors are vertical connectors.

8. The electron device as claimed in claim 5, wherein each of the end region of the associated first element and the end region of the associated second element comprises a circular pad connected to the respective connector.

9. The electron device as claimed in claim 8, wherein a cross-sectional dimension of the circular pad is larger than a cross-sectional dimension of the respective connector.

10. The electron device as claimed in claim 1, wherein the conductive planar slow wave structure comprises a meander line structure.

11. The electron device as claimed in claim 10, wherein the meander line structure comprises:

a first meander line element on a first portion of the support substrate; and a second meander line element on a second portion of the support substrate, wherein the first meander line element and the second meander line element are arranged one over the other and spaced apart from each other, and wherein the dielectric layer arrangement comprises:

a first dielectric layer in between the first meander line element and the first portion of the support substrate, the first dielectric layer being arranged on the first portion of the support substrate at only one or more support substrate portions overlapping with the first meander line element, and a second dielectric layer in between the second meander line element and the second portion of the support substrate, the second dielectric layer being arranged on the second portion of the support substrate at only one or more support substrate portions overlapping with the second meander line element.

12. The electron device as claimed in claim 1, wherein the conductive planar slow wave structure comprises an interdigitated structure, the interdigitated structure comprising:

a plurality of first interdigital elements on a first portion of the support substrate, the plurality of first interdigital elements being coupled to each other; and a plurality of second interdigital elements on a second portion of the support substrate, the plurality of second interdigital elements being coupled to each other, wherein the plurality of first interdigital elements and the plurality of second interdigital elements are arranged one over the other and interdigitated with each other, and wherein the dielectric layer arrangement comprises:

a first dielectric layer in between the plurality of first interdigital elements and the first portion of the support substrate, the first dielectric layer being arranged on the first portion of the support substrate at only one or more support substrate portions overlapping with the plurality of first interdigital elements, and a second dielectric layer in between the plurality of second interdigital elements and the second portion of the support substrate, the second dielectric layer being arranged on the second portion of the support substrate at only one or more support substrate portions overlapping with the plurality of second interdigital elements.

13. The electron device as claimed in claim 1, wherein a dielectric constant of the dielectric layer arrangement is lower than a dielectric constant of the support substrate.

14. The electron device as claimed in claim 1, wherein an electrical conductivity of the dielectric layer arrangement is lower than an electrical conductivity of the support substrate.

15. The electron device as claimed in claim 1, further comprising a metallic enclosure arranged to surround the conductive planar slow-wave structure.

16. The electron device as claimed in claim 1, further comprising an electron source configured to generate the electron beam.

17. The electron device as claimed in claim 1, wherein the electron device is a travelling-wave tube.

18. A method for manufacturing an electron device, the method comprising:

providing a support substrate;

forming a conductive planar slow-wave structure on the support substrate, the conductive planar slow-wave structure being adapted to receive an electromagnetic wave signal for interaction with an electron beam; and forming a dielectric layer arrangement in between the conductive planar slow-wave structure and the support substrate, the dielectric layer arrangement being arranged on the support substrate only on one or more portions of the support substrate which are overlapped by the conductive planar slow-wave structure.

19. The method as claimed in claim 18, further comprising doping the support substrate with dopants.

20. The method as claimed in claim 18, wherein the planar slow wave structure comprises a planar helix structure, and wherein forming the planar slow wave structure comprises:

forming a plurality of first elements on a first portion of the support substrate;

forming a plurality of second elements on a second portion of the support substrate, wherein the plurality of first elements and the plurality of second elements are arranged one over the other; and forming a plurality of connectors, each respective connector of the plurality of connectors is arranged to connect an end region of an associated first element of the plurality of first elements to an end region of an associated second element of the plurality of second elements, and wherein forming a dielectric layer arrangement comprises:

forming a first dielectric layer in between the plurality of first elements and the first portion of the support substrate, the first dielectric layer being arranged on the first portion of the support substrate at only one or more support substrate portions overlapping with the plurality of first elements; and forming a second dielectric layer in between the plurality of second elements and the second portion of the support substrate, the second dielectric layer being arranged on the second portion of the support substrate at only one or more support substrate portions overlapping with the plurality of second elements.

* * * * *